US008851321B2

(12) United States Patent
Ramoo et al.

(10) Patent No.: US 8,851,321 B2
(45) Date of Patent: Oct. 7, 2014

(54) STORAGE TANK CONTAINMENT SYSTEM

(71) Applicant: Altair Engineering, Inc., Troy, MI (US)

(72) Inventors: Regu Ramoo, Ashburn, VA (US); Mohan Parthasarathy, Macomb, MI (US); Thomas Lamb, Lynnwood, WV (US)

(73) Assignee: Altair Engineering, Inc., Troy, MI (US)

( * ) Notice: Subject to any disclaimer, the term of this patent is extended or adjusted under 35 U.S.C. 154(b) by 16 days.

(21) Appl. No.: 13/681,764

(22) Filed: Nov. 20, 2012

(65) Prior Publication Data

US 2013/0146605 A1 Jun. 13, 2013

Related U.S. Application Data

(63) Continuation-in-part of application No. 12/823,719, filed on Jun. 25, 2010, now Pat. No. 8,322,551, which is a continuation-in-part of application No. 11/923,787, filed on Oct. 25, 2007, now abandoned.

(60) Provisional application No. 61/562,213, filed on Nov. 21, 2011, provisional application No. 60/854,593, filed on Oct. 26, 2006.

(51) Int. Cl.
*B65D 90/02* (2006.01)

(52) U.S. Cl.
USPC ..... 220/592; 220/646; 220/647; 220/654

(58) Field of Classification Search
CPC ..... B65D 88/10; B65D 88/12; B63B 25/08; F17C 1/02; F17C 1/005; F17C 1/002
USPC ..... 220/646, 647, 648, 650, 592, 651, 654, 220/563
See application file for complete search history.

(56) References Cited

U.S. PATENT DOCUMENTS 965,455 A * 7/1910 Harry ..... 220/565
1,769,831 A 7/1929 Gramm
2,675,940 A * 4/1954 Schmitz ..... 220/650

(Continued)

FOREIGN PATENT DOCUMENTS

WO 2006001711 A2 1/2006

OTHER PUBLICATIONS

Written Opinion and Search Report dated Mar. 26, 2013 from related PCT/US2012/066073 filed Nov. 20, 2012.

*Primary Examiner* — Stephen Castellano
(74) *Attorney, Agent, or Firm* — Young Basile

(57) ABSTRACT

A CNG or LNG storage containment tank is formed from four substantially vertical hollow tubular walls with first and a second ends positioned approximately 90 degrees apart. Eight horizontal hollow tubular walls interconnect and are in in fluid communication with the respective vertical tubular wall ends to form a six-sided cube-shaped tank configuration defining an interior fluid chamber. A tank support connected to the outer surfaces of the tubular walls and configured to reinforce the tank against loading arising from dynamic movement of fluid within the fluid chamber. In one example, bulkheads are positioned inside the horizontal tubular walls to reduce the sloshing of fluid through the tubular walls and thus the resulting sloshing loads. In another example, a plurality of gusset plates are positioned in a space between the tubular walls at an interior of the tank and connected between the tubular walls to further reinforce the tank.

18 Claims, 19 Drawing Sheets

(56) References Cited

U.S. PATENT DOCUMENTS

| | | | | |
|---|---|---|---|---|
| 3,124,265 | A | 3/1964 | Bertels | |
| 3,314,567 | A | 4/1967 | Becker et al. | |
| 3,414,153 | A | 12/1968 | Leroux | |
| 3,944,106 | A | 3/1976 | Lamb | |
| 4,459,929 | A | 7/1984 | Ffooks | |
| 4,838,449 | A | 6/1989 | Jarnott et al. | |
| 4,946,056 | A * | 8/1990 | Stannard | 220/584 |
| 4,947,988 | A * | 8/1990 | Schutz | 206/386 |
| 5,462,505 | A | 10/1995 | Blair et al. | |
| 5,624,049 | A * | 4/1997 | Kovash et al. | 220/1.5 |
| 6,659,303 | B2 | 12/2003 | Garceau | |
| 6,691,889 | B1 | 2/2004 | Falk | |
| RE41,142 | E | 2/2010 | Blair et al. | |
| 8,322,551 | B2 | 12/2012 | Ramoo et al. | |
| 2001/0040160 | A1 | 11/2001 | Gulati | |
| 2008/0209918 | A1 | 9/2008 | White | |
| 2010/0083671 | A1 | 4/2010 | Liner | |
| 2011/0121003 | A1 * | 5/2011 | Moir | 220/592 |

* cited by examiner

STORAGE TANK CONTAINMENT SYSTEM

CROSS REFERENCE TO RELATED APPLICATIONS

This continuation-in-part application claims priority benefit to U.S. utility patent application Ser. No. 12/823,719 filed Jun. 25, 2010, now U.S. Pat. No. 8,322,551, which is a continuation-in-part of U.S. utility patent application Ser. No. 11/923,787 filed Oct. 25, 2007, now abandoned which claims priority benefit to U.S. provisional patent application Ser. No. 60/854,593 filed on Oct. 26, 2006, the entire contents of all of which are incorporated herein by reference. The present application also claims priority benefit to U.S. provisional patent application Ser. No. 61/562,213 filed Nov. 21, 2011, the entire contents of which are incorporated herein by reference.

FIELD OF THE INVENTION

The embodiments disclosed herein generally pertain to storage tanks and more particularly to storage tanks for fluids including liquids and gases.

BACKGROUND

Industrial storage tanks used to contain fluids such as liquids or compressed gases are common and are vital to industry. Storage tanks may be used to temporarily or permanently store fluids at an on-site location, or may be used to transport fluids over land or sea. Numerous inventions pertaining to the structural configurations of fluid storage tanks have been made over the years. One example of a non-conventional fluid storage tank having a cube-shaped configuration is found in U.S. Pat. No. 3,944,106 to Thomas Lamb, the entire contents of which is incorporated herein by reference.

There has been a progressive demand for the efficient storage and long distance transportation of fluids such as liquid natural gas (LNG), particularly overseas by large ocean-going tankers or carriers. In an effort to transport fluid such as LNG more economically, the holding or storage capacity of such LNG carriers has increased significantly from about 26,000 cubic meters in 1965 to over 200,000 cubic meters in 2005. Naturally, the length, beam and draft of these super carriers have also increased to accommodate the larger cargo capacity. The ability to further increase the size of these super carriers, however, has practical limits.

Difficulties have been experienced in the storage and transportation of fluids, particularly in a liquid form, by ocean carriers. A trend for large LNG carriers has been to use large side-to-side membrane-type tanks and insulation box supported-type tanks. As the volume of the tank transporting the fluid increases, the hydrostatic and dynamic loads on the tank containment walls increase significantly. These membrane and insulation types of tanks suffer from the disadvantage of managing the "sloshing" movement of the liquid in the tank due to the natural movement of the carrier through the sea. As a result, the effective holding capacity of these types of tanks has been limited to either over 80% full or less than 10% full to avoid damage to the tank lining and insulation. The disadvantages and limitations of these tanks are expected to increase as the size of carriers increase.

The prior U.S. Pat. No. 3,944,106 tank was evaluated for containment of LNG in large capacities, for example, in large LNG ocean carriers against a similarly sized geometric cube tank. It was determined that the '106 tank was more rigid using one third the wall thickness of the geometric cube. The '106 tank further significantly reduced the velocity of the fluid, reduced the energy transmitted to the tank and reduced the forces transmitted by the fluid to the tank, resulting in substantially less deformation of the tank compared to the geometric cubic tank.

It was further determined, however, that the '106 configured tank could be improved.

Additional cubic-shaped tank designs have been developed for LNG and compressed natural gas (CNG). Details of these tanks can be found in US Patent Application Publication Nos. 2008/0099489 and 2010/0258571 assigned to the assignee of the present invention, the entire contents of both publications are incorporated herein by reference.

Therefore, it would be advantageous to design and fabricate storage tanks for the efficient storage and transportation of large quantities of fluids such as LNG across land or sea. It is further desirable to provide a storage tank that is capable of being fabricated in ship yards for large LNG Carriers. It is further advantageous to provide a modular-type tank design which facilitates design, fabrication and use in the field.

SUMMARY

The inventive storage tank containment system includes a six-sided generally cube-shaped outer shell having twelve substantially identical cylindrical-shaped walls interconnected to one another at opposing edges to define a storage compartment for fluids, such as LNG. The storage tank containment system may include many external and/or internal structures configured to efficiently and effectively account for and manage the hydro static and hydrodynamic loads from a fluid contained within the storage tank as well as the storage tank itself.

A support structure can be positioned about an exterior of the storage tank to provide radial and lengthwise support and reinforcement to one or more portions of the storage tank. In one example, the components of the support structure are positioned and configured for relatively more reinforcement towards a bottom portion of the storage tank. The support structure can include a base, and the support structure as a whole can be configured to provide controlled lateral and vertical support to the storage tank by accommodating the shape of a storage area, such as a cargo hold of a marine carrier, into which the storage tank is placed.

The storage tank containment system includes internal structures configured for the storage and management of fluid within the storage chamber and elsewhere, as well as for further reinforcement of the storage tank. For instance, bulkhead structures can be positioned in horizontal tubular walls for reducing the sloshing or dynamic movement of the fluid contained in the storage chamber. Corner reinforcements may be provided to reinforce the interior of corner portions of the storage tank at the intersections of the interconnected walls, which may also include features for deterring or easing the dynamic movement of the fluid. Further reinforcement of the storage tank can be realized by positioning and rigidly connecting gusset plates between the walls at the corners.

Openings between the walls can be sealed closed and to form an interior storage chamber suitable for storing additional fluid, greatly enhancing the volumetric storage efficiency of the storage tank containment system.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
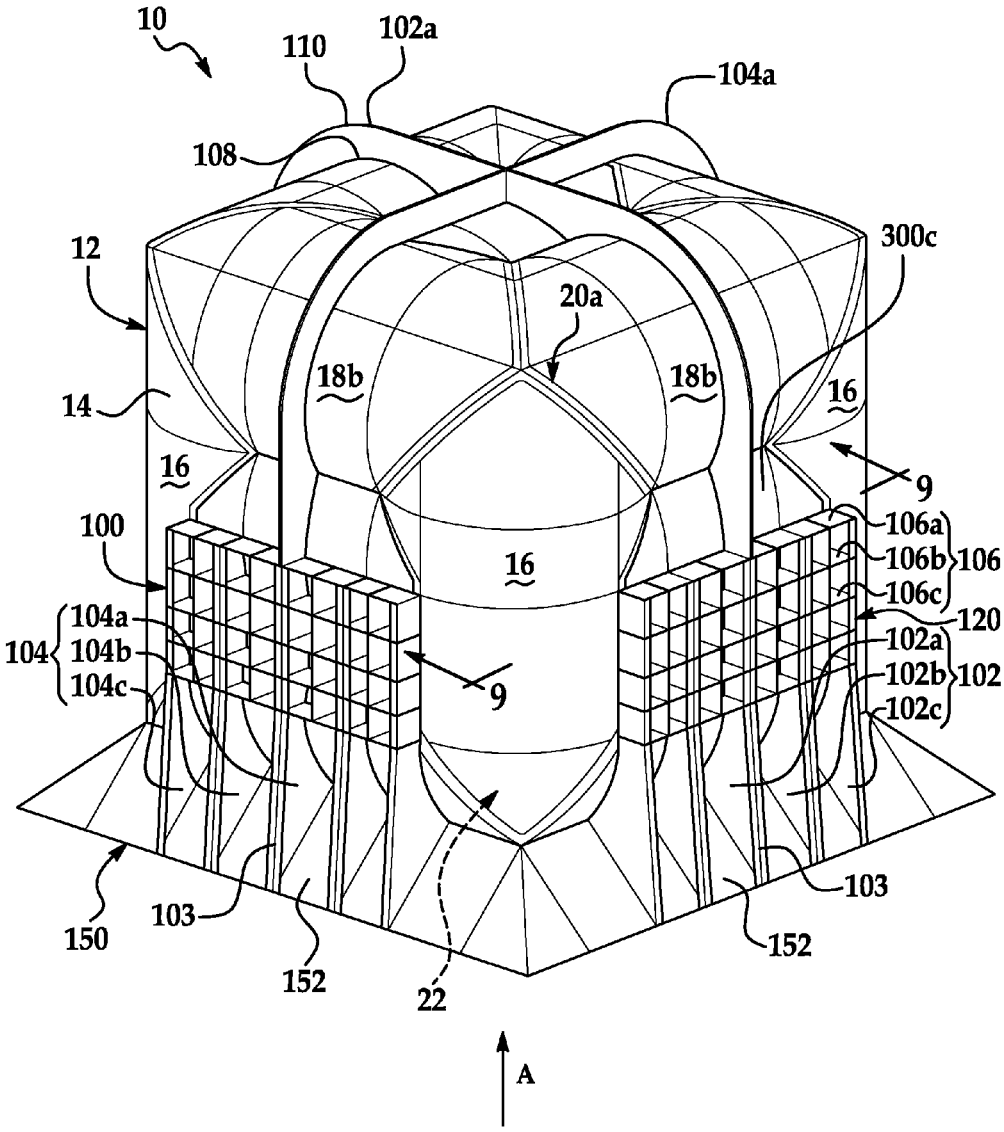
FIG. 1 is a perspective view of a first example of a storage tank containment system having a storage tank and a storage tank support structure.
Figure 2:
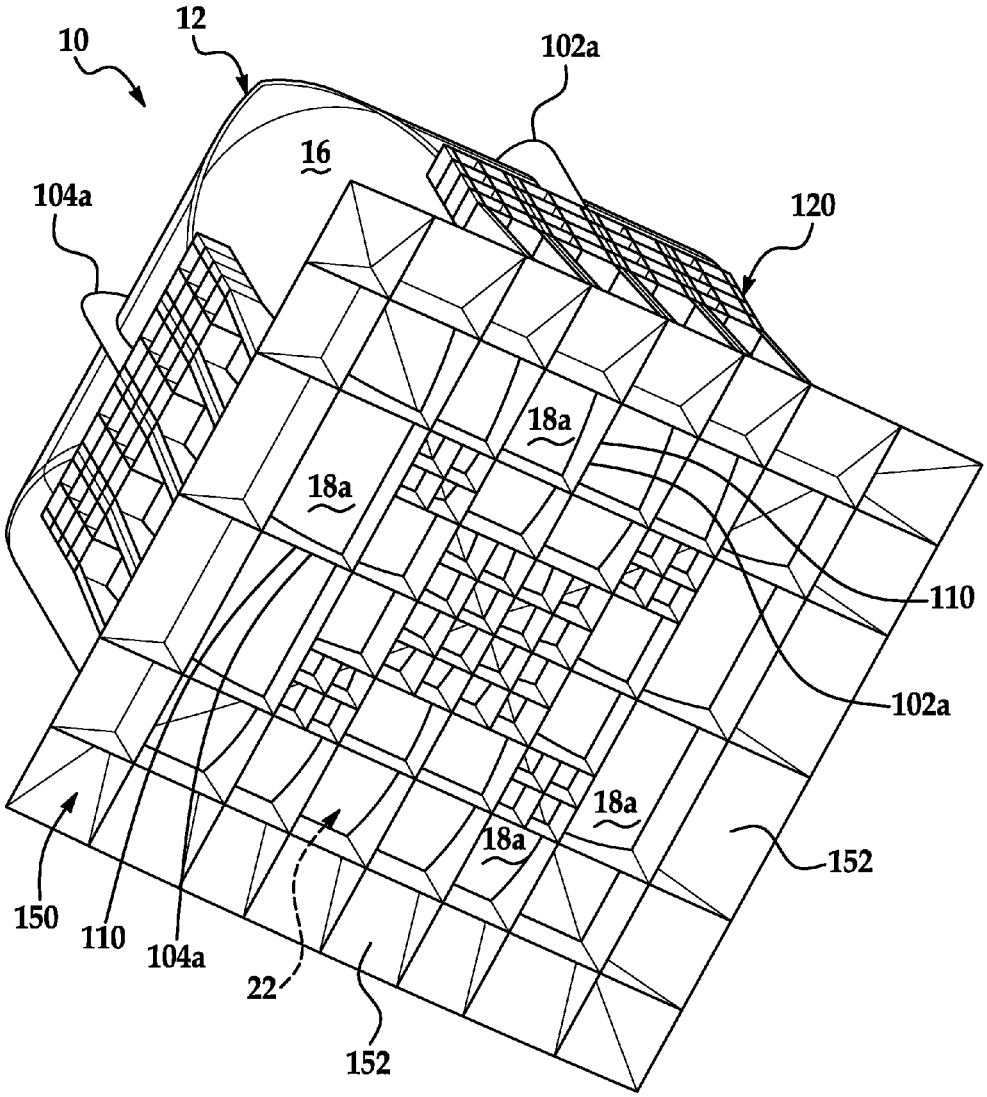
FIG. 2 is a perspective view of the bottom side of the storage tank containment system of FIG. 1 as viewed from the direction of A in FIG. 1.

Examples of storage tank containment systems 10 are shown in FIGS. 1-19. A first example of a storage tank containment system 10 is shown in FIGS. 1-10. Referring to FIGS. 1-3, the first example of a storage tank containment system 10 includes a storage tank 12 having a generally cubic configuration, with six geometric square sides oriented at substantially right angles with respect to one another. The tank 12 is preferably constructed from twelve interconnected hollow or tubular walls 14 (a single exemplary wall 14 is indicated in FIG. 1). In the preferred example, the walls 14 are cylindrical-shaped and have a closed, substantially circular cross-section.

The exemplary storage tank 12 includes four vertically oriented cylindrical, tubular walls 16 positioned approximately 90 degrees apart from one another and eight horizontally oriented cylindrical walls 18 disposed between, and rigidly connecting to, the ends of the vertical walls 16 at corner portions 20*a*. As shown, the eight horizontal cylinder walls 18 include four lower cylinder walls 18*a* arranged at a bottom of the storage tank 12 and four upper cylinder walls 18*b* arranged at a top of the storage tank 12. In a preferred example, each of the vertical walls 16 and horizontal walls 18 can be the same length with substantially identical cross-sections and curvatures. The interconnected hollow cylindrical walls 14 define a storage chamber 22 suitable for containment of materials including fluids, for example liquid natural gas (LNG), maintained at or above atmospheric pressure. Other fluids, such as gasses, known by those skilled in the art may be stored or contained by tank 12. Although described and illustrated as a cube with all six sides having equal dimensions, it is understood that the storage tank 12 can take different geometric configurations, for example, rectangular having longer horizontal dimensions and smaller vertical dimensions. Other shapes and configurations known by those skilled in the art may be used.

Figure 4:
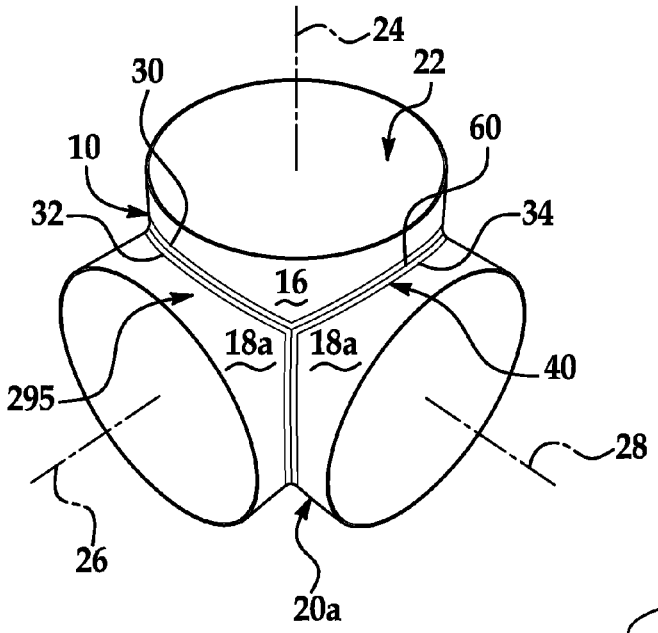
FIG. 4 is a rear partial perspective view of an example of a corner portion of the storage tank as viewed from an interior space of the storage tank.
Figure 5A:
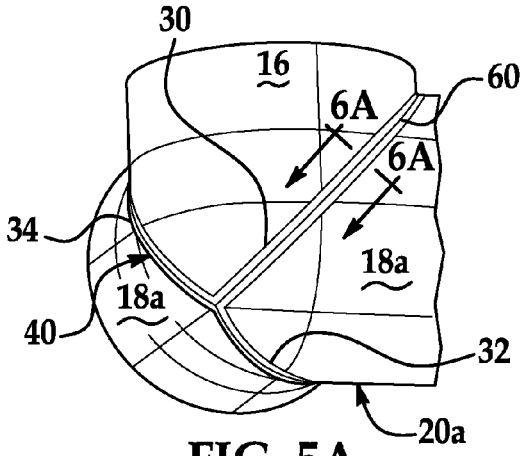
FIG. 5A is a rear partial perspective view of the example corner portion of FIG. 4 as viewed from an interior space of the storage tank.

FIG. 4 shows the example corner portion 20*a* as viewed from an interior space 295 (best seen in FIG. 9) of the storage tank 12, and FIG. 5A shows the corner portion 20*a* as viewed from the exterior of the storage tank 12. In the example, the corner portion 20*a* is disposed adjacent each opposing end of the four vertical cylinder walls 16 for a total of eight corner portions 20*a* forming the eight corners of the exemplary cubic storage tank 12. In the example, a vertical cylinder wall 16 connects to two lower horizontal cylinder walls 18*a*. The vertical cylinder wall 16 extends along a substantially vertical longitudinal axis 24, and the two horizontal cylinder walls 18*a* each extend along an axis 26 and 28, respectively, at substantially right angles to the axis 24. The axes 26 and 28 extend at a substantially right angle with respect to one another in a plane orthogonal to the axis 24, such that the horizontal cylinder walls 18*a* are positioned in a substantially horizontal orientation. The axes 24, 26 and 28 intersect at a point (not shown) inside the corner portion 20*a*. As generally shown, the vertical cylinder wall 16 and the two horizontal cylinder walls 18*a* extend along their respective axes and are generally connected at their respective distal ends 30, 32 and 34 at a joint 40 between the respective cylinder walls, closing off the storage chamber 22. The joint 40 includes a closure member 60 positioned to close a space or gap between the respective distal ends 30, 32 and 34 of the vertical cylinder wall 16 and the two horizontal cylinder walls 18*a*, as explained below, although other configurations for the joint 40 are possible.

Figure 5B:
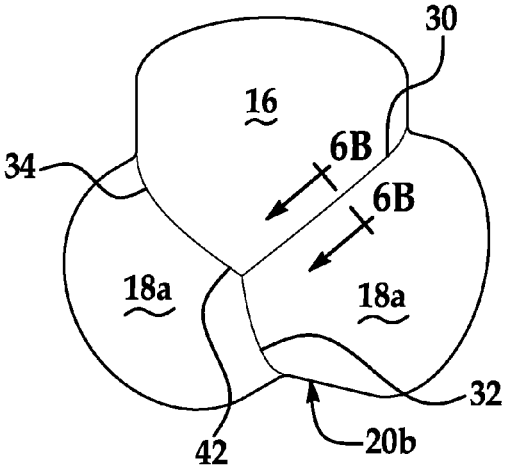
FIGS. 5B and 5C are rear partial perspective views of alternate examples of corner portions as viewed from an interior space of the storage tank.
Figure 5C:
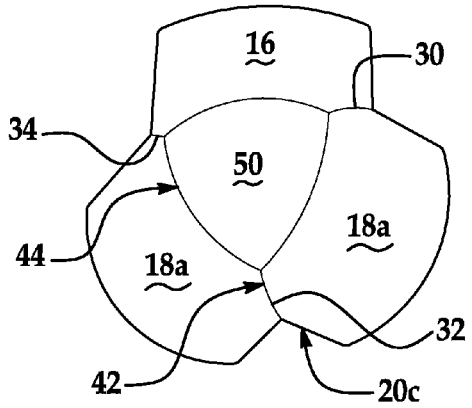

In the alternative example of a corner portion 20*b* shown in FIG. 5B, the vertical cylinder wall 16 and the two horizontal cylinder walls 18*a* are similarly connected at their respective distal ends 30, 32 and 34 at a joint 42. It can be seen that the joint 42 in this example does not include the closure member 60. In yet another alternative example of a corner portion 20*c* shown in FIG. 5C, instead of all of the respective distal ends 30, 32 and 34 of the vertical cylinder wall 16 and the two horizontal cylinder walls 18*a* meeting at the joint 42, an end cap 50 abuts portions of the respective distal ends 30, 32 and 34 at a joint 44 as generally shown. In the example, end cap 50 is spherical in shape, but other shapes, configurations and joints which will close and form a fluid tight corner known by those skilled in the art may be used.

In an alternate example not shown, the corners 20 may be rounded or spherical-shaped to more closely match the contour of the cylindrical walls for manufacturing and/or assembly purposes.

The basic structure for the storage tank 12 is preferably composed of aluminum, although other materials, for example nickel steel, high strength pressure grade steel and other materials, known by those skilled in the art may be used. It is also understood that different components other than those described above and illustrated, as well as in different shapes and orientations, known by those skilled in the art may be used. In a preferred example, during manufacture, the constituent components of the storage tank 12 are rigidly and permanently joined together using a seam welding process in a manner to form a fluid-tight storage chamber 22. For instance, the joints 40, 42 and/or 44 can be completed and sealed to form a fluid tight corner between the vertical 16 and horizontal 18 cylinder walls. The configuration of the completed joints, as well as the processes for completing the joints, may vary according to one or more design, strength, manufacturing and/or other considerations. Examples of these and other joints between constituent parts of the storage tank 12 are explained with reference to FIGS. 6A and 6B.

Figure 6A:
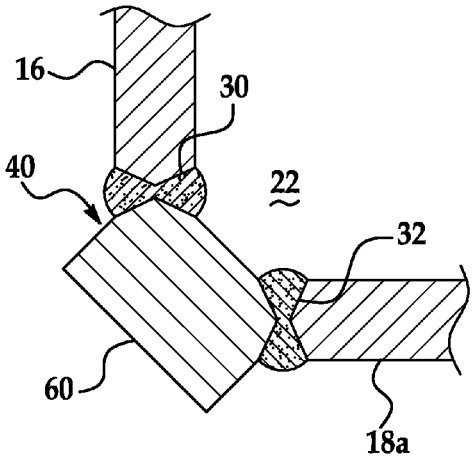
FIGS. 6A and 6B are section views taken along the line 6A-6A in FIG. 5A and line 6B-6B in FIG. 5B, respectively, showing example methods for completing a joint between constituent parts of the corner portions.

FIG. 6A is a cross section of the joint 40 in FIG. 5A between the vertical wall 16 and a horizontal wall 18*a*. According to this example, the storage tank 12 is assembled prior to completing the joint 40 such that a space or gap is present between the respective distal ends 30 and 32 of the vertical wall 16 and the horizontal wall 18*a* prior to completing the joint 40. As shown, a closure member 60 is sized and configured to substantially close the gap between the respective distal ends 30 and 32. The closure member 60 extends along the joint 40, and as can be understood with reference to FIGS. 4 and 5A, the closure member 60 has three generally annular, open ended ring shaped portions in the example corner portion 20*a*. However, the closure member 60 can have other shapes that may vary depending upon its application in alternative corner portions and/or joints between other constituent parts of the storage tank 12. The closure member 60 can have advantageous use where it is not feasible, cost effective or otherwise desirable to manufacture and/or assemble constituent parts of the storage tank 12 according to tolerances allowing for direct welding. Additionally or alternatively, the closure member 60 may be included to perform a strengthening or reinforcing function in the joint 40.

The respective distal ends 30 and 32 of the vertical wall 16 and the horizontal wall 18*a* are chamfered from both an interior side (facing the storage chamber 22) and exterior side of the walls, such that a pointed vertex is formed at each of the distal ends 30 and 32, although the vertexes could alternatively be rounded, for example. The illustrated closure member 60 is shaped with a rectangular cross section and oriented so that pointed vertexes oppose each of the points of the distal ends 56 and 58. In this configuration, four inwardly tapering grooves are formed. Specifically, two grooves are formed for receiving welds to join the vertical wall 16 to the closure member 60, and two grooves are formed for receiving welds to join the closure member 60 to the horizontal wall 18*a*. The cross section of the closure member 60 can be differently sized or shaped, for example, depending upon the size of the gap to be closed. It will be understood that one or more of the distal ends 30 and 32 and the closure member 60 could be shaped and configured otherwise than specifically illustrated. For instance, the distal ends 30 and 32 and the opposing portions of the closure member 60 could alternatively be rounded, for example, and the distal ends 30 and 32 and the closure member 60 could be formed so that grooves are only formed that open to one of an exterior side or interior side of the walls 16 and 18*a*.

Figure 6B:
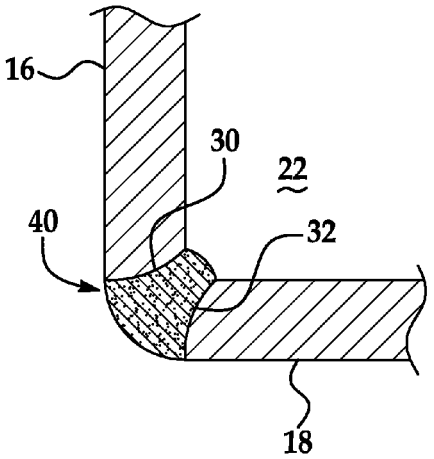

FIG. 6B is a cross section of the joint 42 in FIG. 5B between the vertical wall 16 and a horizontal wall 18*a*. According to the example joint 42 illustrated in FIG. 6B, the storage tank 12 is assembled prior to completing the joint 42 such that respective distal ends 30 and 32 of the vertical wall 16 and the horizontal wall 18*a* to be joined are substantially adjacent and can be continuously seam welded or otherwise mechanically joined together to complete the joint 42. In the illustrated example, the respective distal ends 30 and 32 of the vertical wall 16 and the horizontal wall 18*a* are chamfered from both the interior side and the exterior side of the walls, such that a pointed vertex is formed at each of the distal ends 30 and 32. Inwardly tapering grooves are formed by the opposing points of the distal ends 30 and 32, which are sized and shaped for receiving a weld to join the vertical wall 16 and the horizontal wall 18*a*. It will be understood that the distal ends 30 and 32 could alternatively be rounded, for example, or could be formed so that a single groove is formed that opens to only one of the exterior side or the interior side of the walls 16 and 18*a*.

Other configurations and orientations of the joints formed by the intersection of the vertical 16 and horizontal 18*a* cylinder walls at the corners portions known by those skilled in the art may be used. In addition, it will be understood that the illustrated joints are explained with reference to the corner portions only for illustration, and that the examples described are applicable in principle to any other joints or seams between constituent parts of the storage tank 12.

The disclosed storage tank containment system 10 includes additional external and/or internal structures configured to efficiently and effectively account for and manage the static and dynamic loads from a fluid contained within the storage tank 12, as well as the loads from the storage tank 12 itself.

A representative exterior support structure 100 connected to the outer surfaces of the storage tank 12 is illustrated in a first example with reference to FIGS. 1-3, 7 and 8. The support structure 100 is generally positioned about an exterior of the walls 14 to provide radial support and/or reinforcement to one or more portions of the storage tank 12, in order to strengthen the storage tank containment system 10 against stress arising from movement of the fluid within the storage chamber 22, as well as a stress from the bulk of the storage tank containment system 10 as a whole. The first exemplary support structure 100 includes a plurality of first braces 102 (i.e., 102*a*, 102*b*, 102*c*, etc.), a plurality of second braces 104 (i.e., 104*a*, 104*b*, 104*c*, etc.), and a plurality of third braces 106 (i.e., 106*a*, 106*b*, 106*c*, etc.). A base 150, further described below, is also used. It will be understood that certain constituent components of the support structure 100 and base 150 that are described and/or illustrated as discrete connected components could be integral, for example, and vice versa.

In the first example, each of the braces 102, 104 and 106 are substantially planar members that extend outward from the storage tank 12 and have interior portions 108 (a representative interior portion 108 is indicated for the brace 102*a*) sized and shaped to closely circumscribe selected exterior portions of the storage tank 12. In the first example, the braces 102 and 104 are vertically oriented and horizontally spaced, and are aligned at right angles with respect to one another in parallel to the respective edges of the sides of the storage tank 12. The braces 106 are horizontally oriented and vertically spaced, and are similarly aligned in parallel to the respective edges of the sides of the storage tank 12. The braces 102, 104 and 106 are generally positioned and oriented to reinforce and provide radial support to selected outer portions of the adjacent horizontal and vertical cylinder walls 16 and 18 that respectively form the six sides of the storage tank 12.

For instance, in the first example, the braces 102, 104 and 106 interconnect to form portions 120 of the support structure 100 that circumscribe the storage tank 12 along the outwardly facing portions of the lower cylinder walls 18*a* that form the upright sides of the storage tank 12. It can be seen that the components of the portions 120 of the support structure 100 shown can further be shaped and positioned to abut a closure plate 300*b* or 300*c*, described in further detail below, as well as additional portions of the storage tank 12.

Each of the portions 120 of the support structure 100 comprises vertically oriented braces 102 abutting the outwardly facing portions of two parallel lower cylinder walls 18*a*, so as generally circumscribe parts of two opposing upright sides of the storage tank 12. In the illustrated example, the braces 102 further circumscribe a bottom side of the storage tank 12. The braces 102 extend vertically to a position approximately at the middle of the two opposing upright sides of the storage tank 12. The braces 102 are spaced horizontally such that an outer brace 102*c* of the braces 102 is positioned to extend upward along a vertical cylinder wall 16 in a radial direction from the vertical cylinder wall 16, as well as in abutment with a circumferential portion of a connected horizontal cylindrical wall 18*a*.

The portions 120 similarly comprise vertically oriented braces 104 abutting the outwardly facing portions of the other two parallel lower cylinder walls 18*a*, so as generally circumscribe the bottom side of the storage tank 12, as well as parts of the other two opposing upright sides of the storage tank 12 than the braces 102. The braces 104 also extend vertically to a position approximately at the middle of the two opposing upright sides of the storage tank 12. The braces 104 are spaced horizontally such that an outer brace 104*c* of the braces 104 is positioned to extend upward along a vertical cylinder wall 16 in a radial direction from the vertical cylinder wall 16, as well as in abutment with a circumferential portion of a connected horizontal cylindrical wall 18*a*.

Figure 3A:
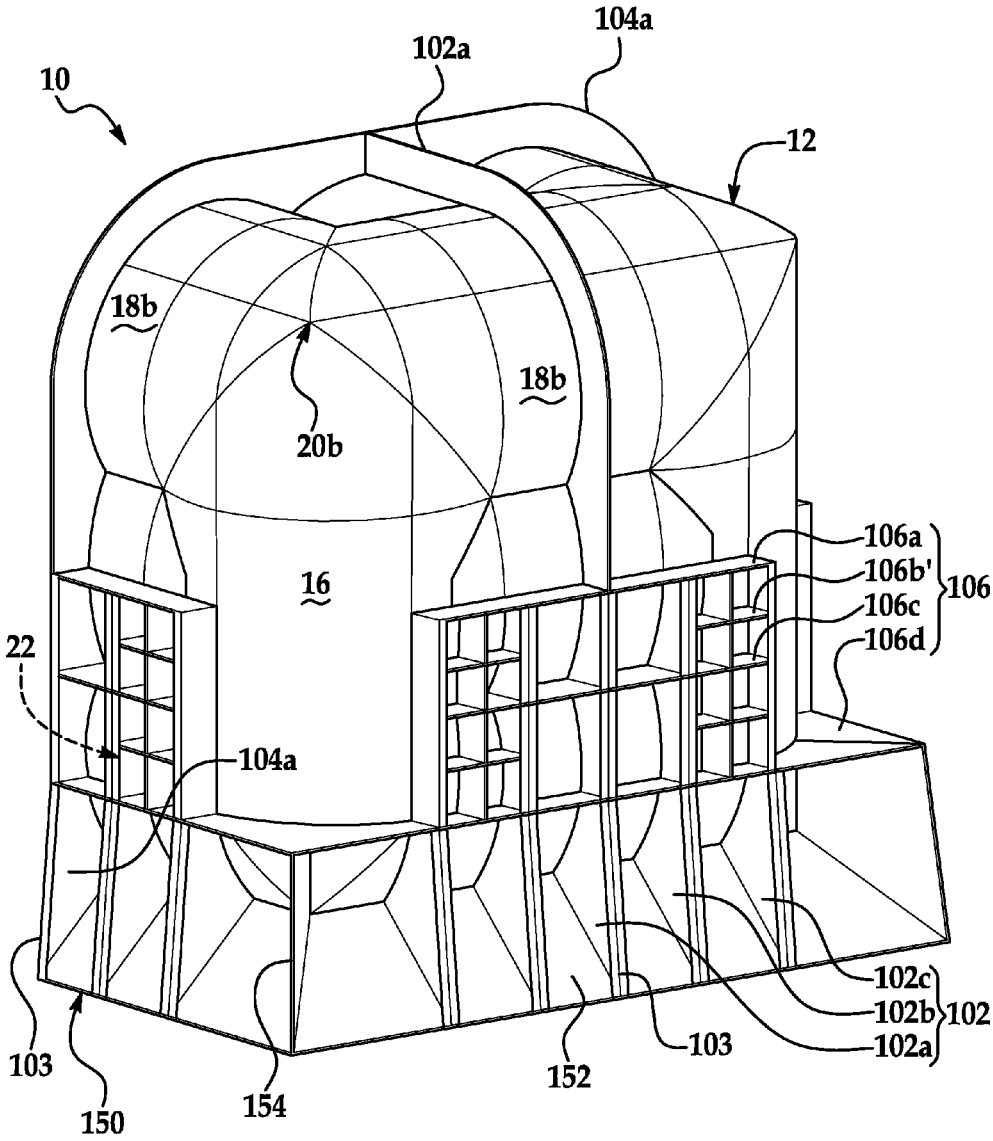
FIGS. 3A-3C are a perspective views of the storage tank system containment of FIG. 1 showing possible variations in the configuration of the support structure.

The horizontal braces 106 in this example can optionally rigidly interconnect the braces 102 and braces 104 comprising the portions 120 at each respective upright side of the storage tank 12. It will be understood that any of the braces 102, 104 and 106 can be provided in alternative numbers and/or configurations. For instance, as shown in FIG. 3A, a brace 106*d* may optionally be configured to substantially circumscribe the storage tank 12. The brace 106*d* is positioned to extend along the four horizontal cylinder walls 18*a* in a radial direction from the horizontal cylinder walls 18*a*, as well as in abutment with circumferential portions of connected vertical cylindrical walls 16. In addition, it can be seen that certain portions of the braces 106 interconnecting the braces 102 and braces 104 are not included in this variation.

In addition, central braces 102*a* and 104*b* of the braces 102 and 104 are configured to substantially circumscribe the storage tank 12. As shown, the central braces 102*a* and 104*b* are positioned to abut the outwardly facing portions of four of the eight cylinder walls 18*a* and 18*b* that extend in parallel, so as generally circumscribe a bottom side of the storage tank 12, two opposing upright sides of the storage tank 12, and a top side of the storage tank 12. It can be seen that the central braces 102*a* and 104*b* intersect at the bottom side and the top side of the storage tank 12 and interconnect the four portions 120 of the support structure 100 circumscribing the outer portions of the four lower cylinder walls 18*a* as described above.

The concentration of braces 102, 104 and 106 toward the lower bottom half of the storage tank 12 are used to fortify the lower portion of the storage tank 12 and its capacity for hydrostatic and other forces. In the second example, T-plates 103 are selectively connected to braces 102 and 104 perpendicular to the braces to form a T-shaped section for increased strength of the braces against buckling and other deformation. As best shown in FIG. 2, it is also contemplated that concentrations of braces can be selectively incorporated into the base 150, for example, at a center of the bottom side of the storage tank 12.

Figure 3B:
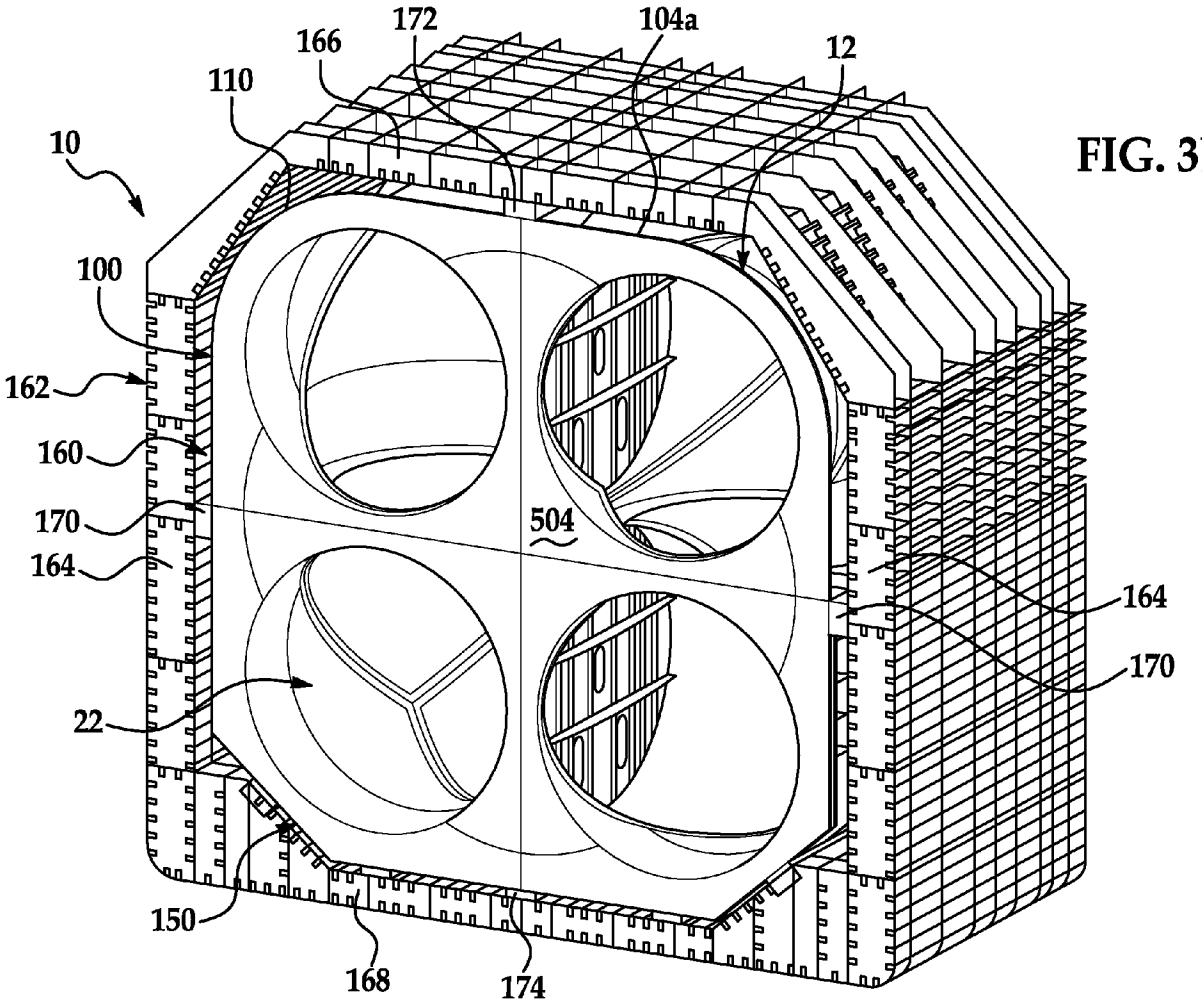
Figure 3C:
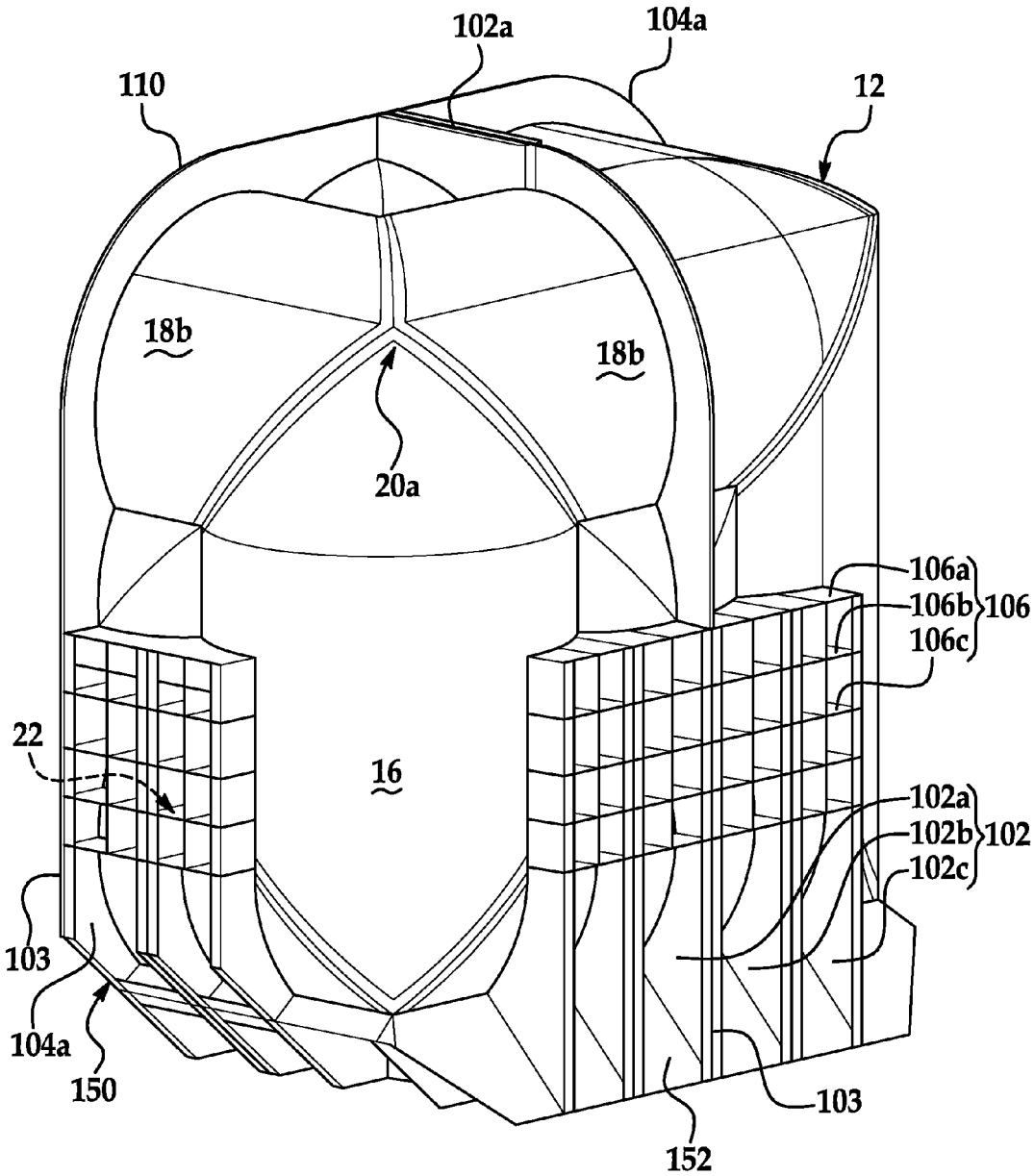

FIGS. 3B and 3C show an optional variation in the configuration of the support structure 100, wherein the support structure 100 is further designed to provide controlled lateral and vertical support to the storage tank 12 by accommodating the shape of a storage area, such as a cargo hold 160 of a marine carrier 162 (shown in FIG. 3B but not in FIG. 3C for clarity), into which the storage tank 12 is placed. For example, peripheries 110 (a representative periphery 110 is indicated for the brace 104*a*) sized of the braces 102, 104 and 106 opposing the respective portions of the openings 108 that circumscribe the sides of the storage tank 12 can be configured to abut and/or engage upright walls 164 and/or an overhead wall 166 defining the cargo hold 160.

Further, or in the alternative, devices for securing the containment system 10 and the storage tank 12 to the cargo hold 160 may be positioned between the walls 164 of the cargo hold 160 and portions of the containment system 10 to inhibit movement of the containment system 10 with respect to the cargo hold 160 in the event, e.g., of a rolling or pitching motion of the carrier 162. For instance, as shown, chocks 170 are positioned between the upright walls 164 and upright portions of the support structure 100 of the containment system 10. Further, in the illustrated example, chocks 172 are positioned between the overhead wall 166 and an upper portion of the support structure 100. The chocks 172 may have advantageous use in the event, e.g., a flooding of the cargo hold 160, to inhibit the containment system 10 from floating. Although chocks 170 and 172 are shown and described, other devices known by those skilled in the art may be used.

In a preferred example, first 102, second 104 and third 106 braces are made from aluminum plate, and the respective openings 108 are sized to conform to the portions of the exterior of the storage tank 12 at which the braces are selectively positioned. It is understood that other materials described above for the walls 14, and others known by those skilled in the art, may be used.

The storage tank containment system 10 includes a base 150 for supporting the storage tank 12 on a rigid support surface, for example, a floor 168 of the cargo hold 160. In one example, base 150 is formed by vertical braces 102 and 104 as best seen in FIG. 2. In the example, the peripheries 110 of the vertical braces 102 and 104 opposing the respective portions of the openings 108 that circumscribe the bottom of the storage tank 12 can form a substantially planar platform or surface to form a base 150, as shown in FIG. 2, providing a flat footprint for the storage tank 12 to abut a flat floor 168 of the cargo hold 160.

The base 150 can be formed partly or in whole with the braces 102 and 104, as described above, or can be formed with alternative structures, either alone or in combination with the braces 102 and 104. The illustrated base 150 is reinforced by an angularly oriented reinforcement skirt 152 adjacent to the bottom sides of the storage tank 12. As shown in FIG. 3A, a plurality of rigidly connected reinforcement webs 154 may also be used.

The base 150, skirt 152 and/or webs 154 can be shaped similarly to the support structure 100 as described above with reference to FIGS. 3B and 3C to accommodate the shape of the cargo hold 160. For example, the peripheries 110 of the vertical braces 102 and 104 forming the base 150 are chamfered in the variation of FIGS. 3B and 3C to approximate the cross section of the cargo hold 160 between the upright walls 164 and the floor 168. Further, devices for supporting the containment system 10 and the storage tank 12 within the cargo hold 160 may be positioned between the floor 168 of the cargo hold 160 and the base 150. For instance, as shown, chocks 174 are positioned between the floor 168 and the base 150 of the containment system 10. Although chocks 174 are shown and described, other devices known by those skilled in the art may be used to support the containment system 10 within the cargo hold 160. The above described variation is provided as a non-limiting example, and it will be understood that many other variations in the components of the support structure 100 and/or base 150 are possible depending upon the specific configuration of the cargo hold 160.

The base 150 is secured to the adjacent storage tank 12 structures in the manner described for the walls 14 and braces 102, 104 and 106. The structures forming the base 150 can be made from the same materials as the braces described above or may be made from other materials and configurations known by those skilled in the art.

The composition and configuration of the components of the representative exterior support structure 100 may vary according to one or more design, strength, manufacturing and/or other criteria. For example, it is contemplated that the above described exterior support structure 100 can be modified or differently designed according to actual, anticipated and/or simulated static and dynamic loads from a fluid contained within the storage tank 12, as well as the loads from the storage tank 12 itself. Therefore, it will be understood that variations in the number, placement and orientation of the braces 102, 104 and 106 can be made. Similar variations in the construction and materials of the base 150 known by those skilled in the art may be used. One instance of a possible modification to the representative exterior support structure 100 is utilized in a second example of a storage tank containment system 10 shown in FIGS. 11-19.

Figure 11:
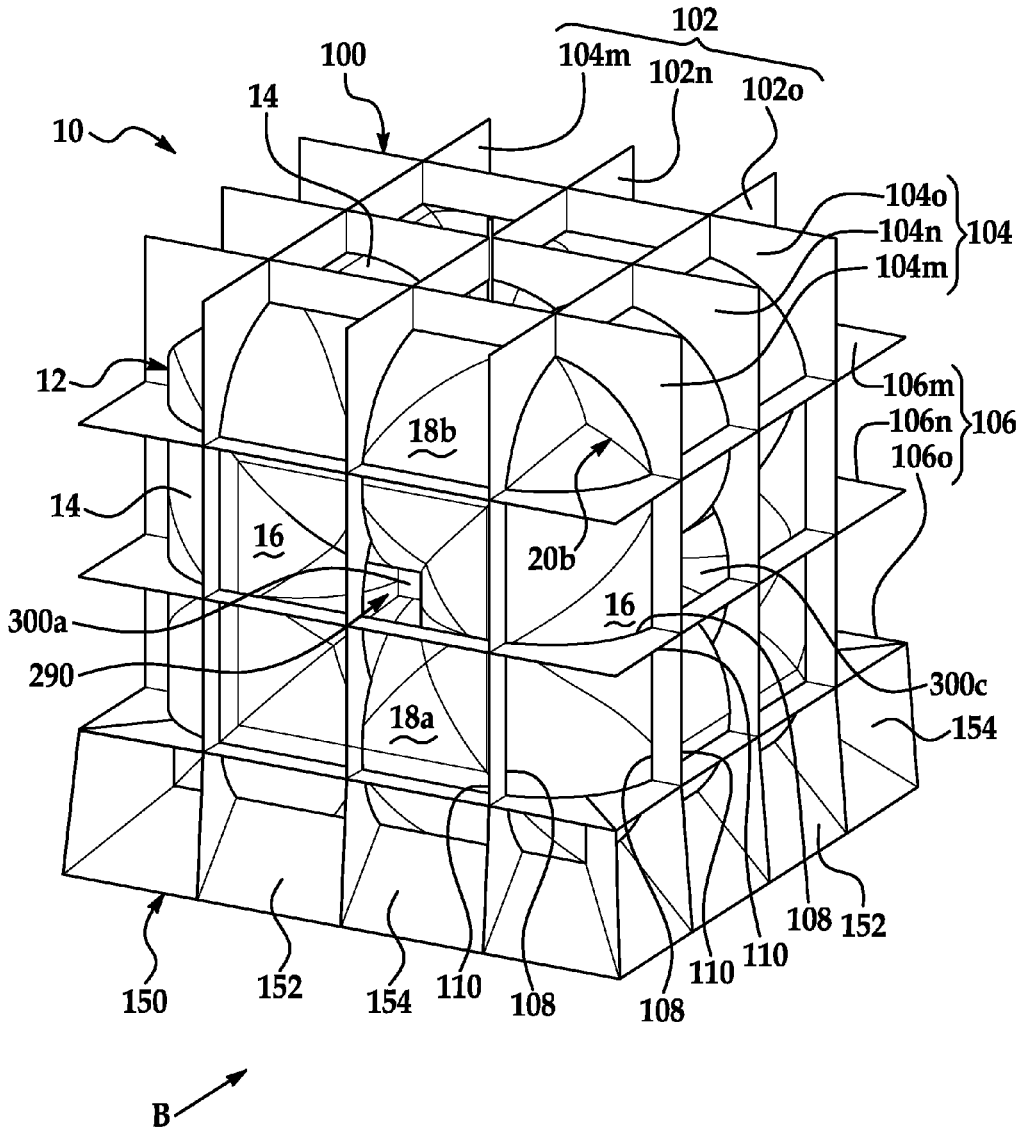
FIG. 11 is a perspective view of a second example of a storage tank containment system having the storage tank and an alternate storage tank support structure.
Figure 12:
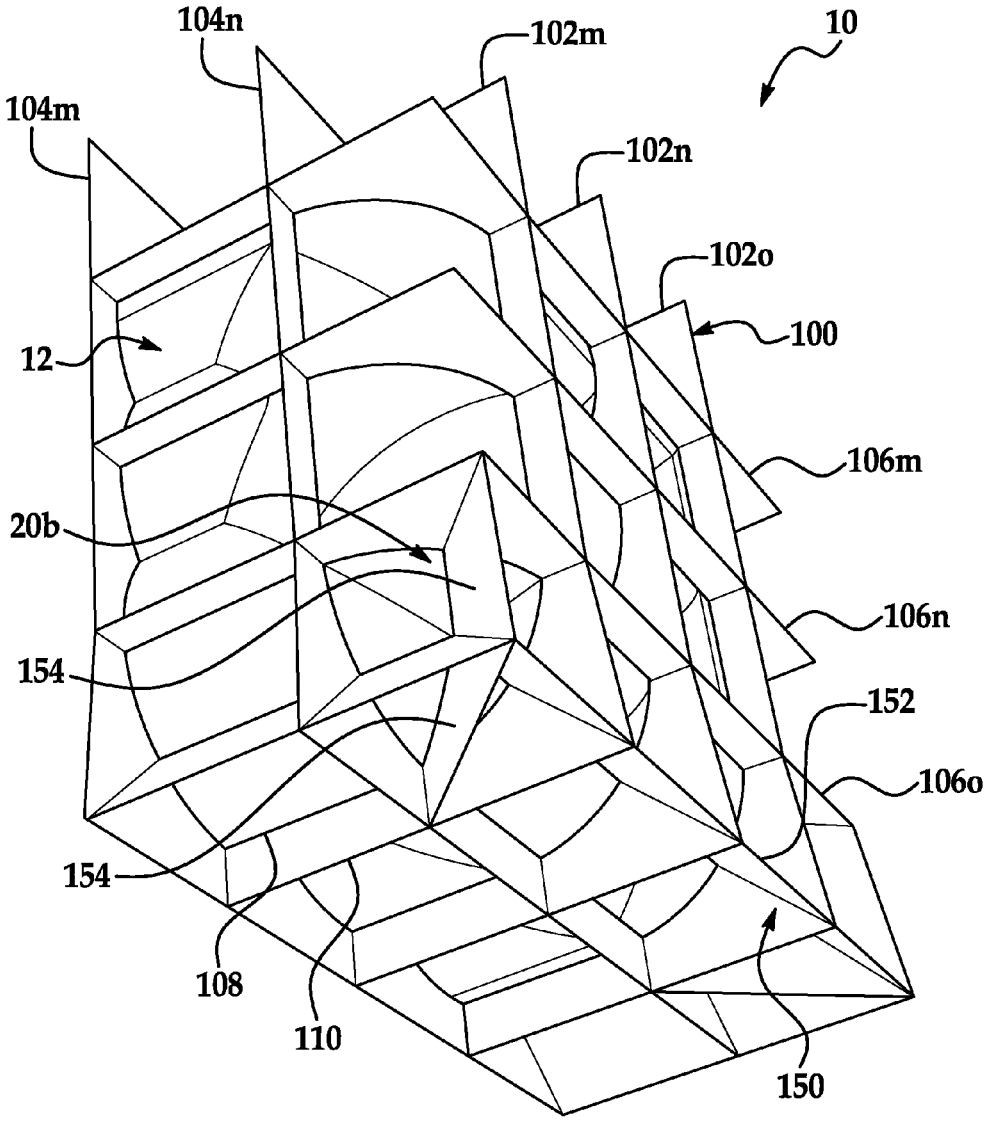
FIG. 12 is a perspective view of the bottom side of the storage tank containment system of FIG. 11 as viewed from the direction of B in FIG. 11.

Referring to FIGS. 11 and 12, the support structure 100 in the second example generally includes the first braces 102 (identified with 102*m*, 102*n* and 102*o* in the second example), second braces 104 (identified with 104*m*, 104*n* and 104*o*), and third braces 106 (identified with 106*m*, 106*n* and 106*o*). The base 150 as generally described above with is also used. In the second example, each of the braces 102, 104 and 106 are substantially planar members that each defines an interior opening 108 sized to closely circumscribe selected exterior portions of the storage tank 12. In the example, the braces 102 and 104 are vertically oriented and horizontally spaced, and are aligned at right angles with respect to one another in parallel to the respective edges of the sides of the storage tank 12. The braces 106 are horizontally oriented and vertically spaced, and are similarly aligned in parallel to the respective edges of the sides of the storage tank 12. As with the first example, the braces 102, 104 and 106 are generally positioned and oriented to reinforce and provide radial support to selected outer portions of the adjacent horizontal and vertical cylinder walls 16 and 18 that respectively form the six sides of the storage tank 12.

In the second example, each of the braces 102, 104 and 106 are configured to substantially circumscribe the storage tank 12. In relation to a single side of the storage tank 12, two outer braces 102*m* and 102*o* of the braces 102 are each positioned to extend upward along a vertical cylinder wall 16 in a radial direction from the vertical cylinder wall 16, as well as in abutment with circumferential portions of connected horizontal cylindrical walls 18*a* and 18*b*. Similarly, two outer braces 104*m* and 104*o* of the braces 104 are each positioned to extend upward along a vertical cylinder wall 16 in a radial direction from the vertical cylinder wall 16, as well as in abutment with circumferential portions of connected horizontal cylindrical walls 18*a* and 18*b*. Finally, two outer braces 106*m* and 106*o* of the braces 106 are each positioned to extend horizontally along a horizontal cylinder wall 18 in a radial direction from the horizontal cylinder wall 18, as well as in abutment with circumferential portions of connected vertical cylindrical walls 16.

Although the outer of the braces 102, 104 and 106 are described for clarity in relation to a single face of the storage tank 12, it will be understood from the Figures that the outer of the braces 102, 104 and 106 may be configured to circumscribe multiple faces of the storage tank 12. For instance, it can be seen that the outer of the braces 102, 104 and 106 can circumscribe four faces of the storage tank 12 to generally form a loop around the storage tank 12, with four constituent portions each positioned and oriented similarly in principle to those described above with respect to a single face.

Central braces 102*n* and 104*n* are positioned to abut the outwardly facing portions of four of the eight cylinder walls 18*a* and 18*b* that extend in parallel, so as generally circumscribe a bottom side of the storage tank 12, two opposing upright sides of the storage tank 12, and a top side of the storage tank 12. Central brace 106*n* is positioned to abut the outwardly facing portions of the four vertical cylinder walls 16, so as generally circumscribe all four upright sides of the storage tank 12. The central braces 102*n*, 104*n* and 106*n* can span spaces 290 on the sides of the storage tank 12 created between the spaced cylinder walls 14. However, the medial brace can further be shaped and positioned to abut a closure plate 300*c*, described in further detail below.

It can be seen that the braces 102, 104 and 106 positioned as described and shown can be rigidly interconnected at their respective intersections to form a reinforcing lattice structure around the storage tank 12. In one variation of the second example of the representative exterior support structure 100 not shown, it is contemplated that one or more of the upper braces 106 can be reduced in load bearing capacity due to the gradual reduction in hydrostatic forces placed on the storage tank 12 by its contents. For example, because the hydrostatic load on an interior of the walls 14 will be greater nearer the base 150, a support structure 100 including a plurality of horizontally oriented braces 106 can include a first brace 106 relatively stronger than a second brace 106 positioned further from the base 150 than the first brace 106. It is further contemplated, however, that depending on the application, such gradual reduction in hydrostatic forces may be offset by anticipated dynamic loading in certain applications.

Like the first example, the first 102, second 104 and third 106 braces of the second example are made from aluminum plate, and the respective openings 108 are sized to conform to the portions of the exterior of the storage tank 12 at which the braces are selectively positioned. It is understood that other materials described above for the walls 14, and others known by those skilled in the art, may be used.

The disclosed storage tank containment systems 10 of the first and second examples further includes internal structures configured for the storage and management of fluid within the storage chamber 22, or elsewhere, as described below, as well as for further reinforcement of the storage tank 12. It will be understood that the various internal structures and other features described below with reference to one or both of the first and second examples of the storage tank containment system 10 can be used in any combination with each other, as well as in further combination with one or more features of the above described examples of the support structure 100.

In a preferred example of a containment system 10 for storing liquids, such as LNG, the storage tank 10 can include bulkhead structures 200*a*, 200*b*, 200*c* and/or 200*d* positioned within and secured to the storage chamber 22, as shown in FIGS. 7, 13, 17 and 18, respectively. The bulkhead structures 200 are located in each of the horizontal tubular walls 18 as generally shown in the Figures for deterring or easing the sloshing or dynamic movement of the fluid contained in the storage chamber 22. In a preferred example, each bulkhead 200 is positioned and secured to the adjacent walls 18 substantially midstream of a horizontal tube 18. As explained above, the sloshing movement of liquid contained in the walls 14 creates a corresponding dynamic load on the interior of the walls 14. The bulkhead structures 200 provides an internal structure to partially obstruct flow of the liquid contained in the horizontal walls 18, which reduces the extent of sloshing and lowers the magnitude of the dynamic loads received by the ends of the horizontal walls 18. In addition, it will be understood that all or part of the bulkhead structures 200 may be configured to perform a reinforcing function of the cylindrical cross section of the wall 14.

Figure 7:
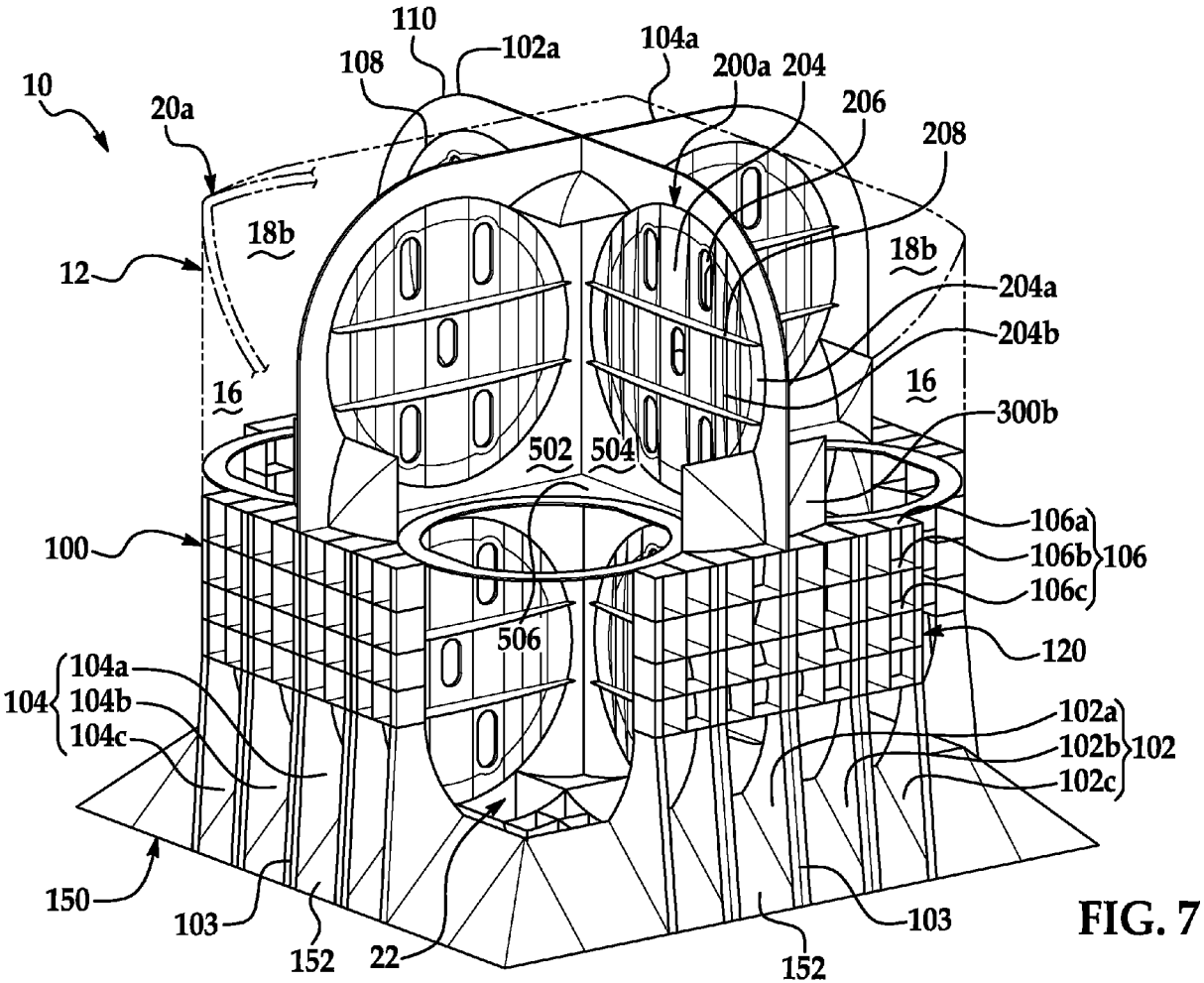
FIG. 7 is a perspective view of the storage tank containment of FIG. 1 with the storage tank in phantom to show examples of bulkheads positioned in the horizontal cylinder walls of the storage tank and gusset plates within the interior space of the storage tank.

As shown in FIG. 7, an exemplary bulkhead structure 200*a* includes a substantially planar plate 204 configured to span a cross section of the horizontal walls 18 defining a portion of the storage chamber 22. In the example, the planar plate 204 defines a plurality of ovoid apertures 206 arranged in an "x" pattern about the plate 204 to permit fluid communication on either side of the plate 204.

A material of an outer periphery 204*a* of the planar plate 204 may be relatively more rigid than a material of an inner portion 204*b* of the planar plate 204. In this arrangement, the outer periphery 204*a* of the planar plate 204 performs a reinforcing function for the cylindrical cross section of the wall 14, while the inner portion 204*b* acts as a membrane to partially obstruct flow of the liquid contained in the horizontal walls 18 by, for example, defining the apertures 206 as shown. Although it is understood that a variety of materials in varying thicknesses may be used, in an application of tank system 10 in the size example noted above for containing LNG, a thickness of an aluminum material forming the plate 204 may be approximately 4-5 inches at the outer periphery 204*a*, while the inner portion 204*b* may be approximately 1-2 inches thick. In this example, a plurality of cross members 208 may be further provided to reinforce the inner portion 204*b* against a dynamic loading normal to the planar plate 204 arising from a flow of liquid contained in the horizontal walls 18.

It is understood that alternate configurations for the planar plate 204 can be used, and that more or fewer apertures may be used and that the apertures 206 can have any suitable polygonal or rounded profile to suit the particular contents or application as known by those skilled in the art. For instance, the planar plate 204 may be configured with substantially uniform thickness. In addition, in the example bulkhead structure 200*b* shown in FIG. 13, each plate 204 defines six rectangular apertures 206 arranged in two rows of three apertures 206. In another example of a bulkhead structured 200*c* shown in FIG. 17, a plurality of polygonal apertures 206 are arranged about a periphery of the planar plate 204. In the example of a bulkhead structured 200*d* shown in FIG. 18, a plurality of polygonal apertures 206 are arranged uniformly about the planar plate 204.

Figure 15:
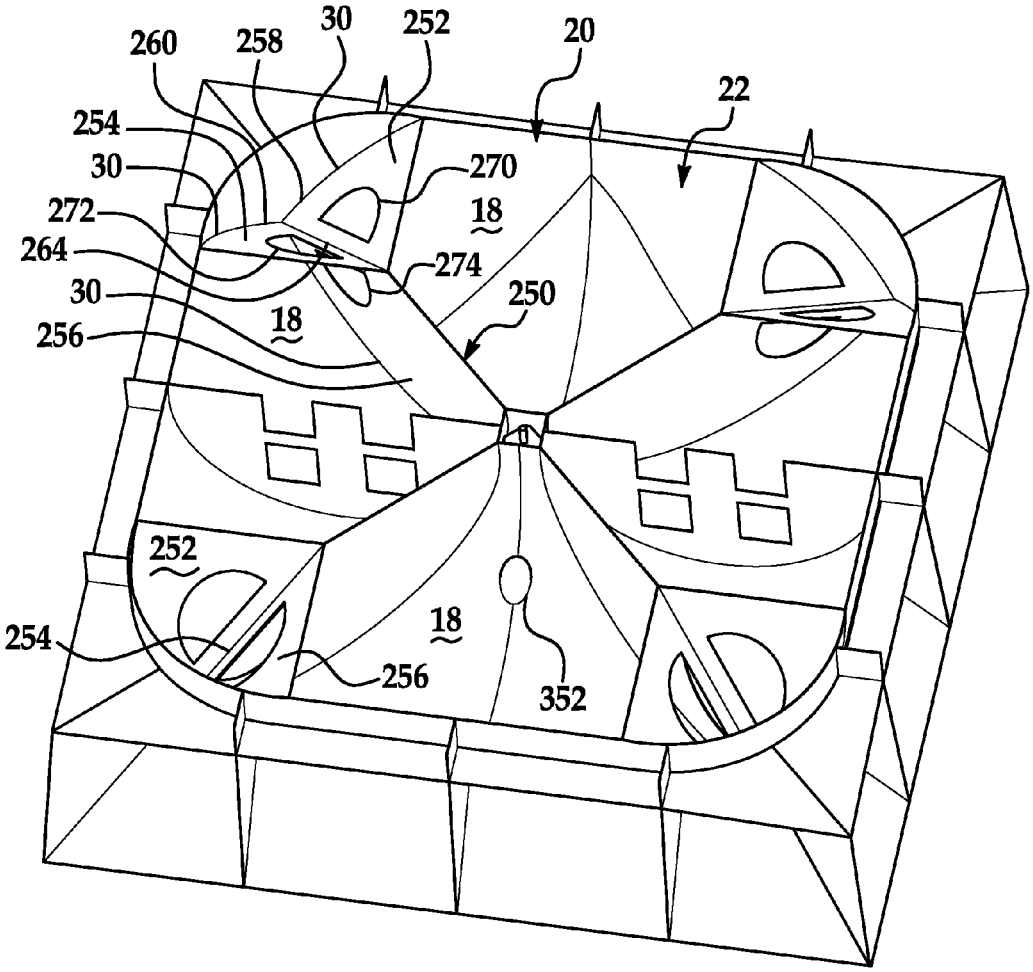
FIG. 15 is a cut-away perspective view of the storage tank containment system in FIG. 11 showing an example of corner reinforcements positioned in the bottom corners of the storage tank.
Figure 16:
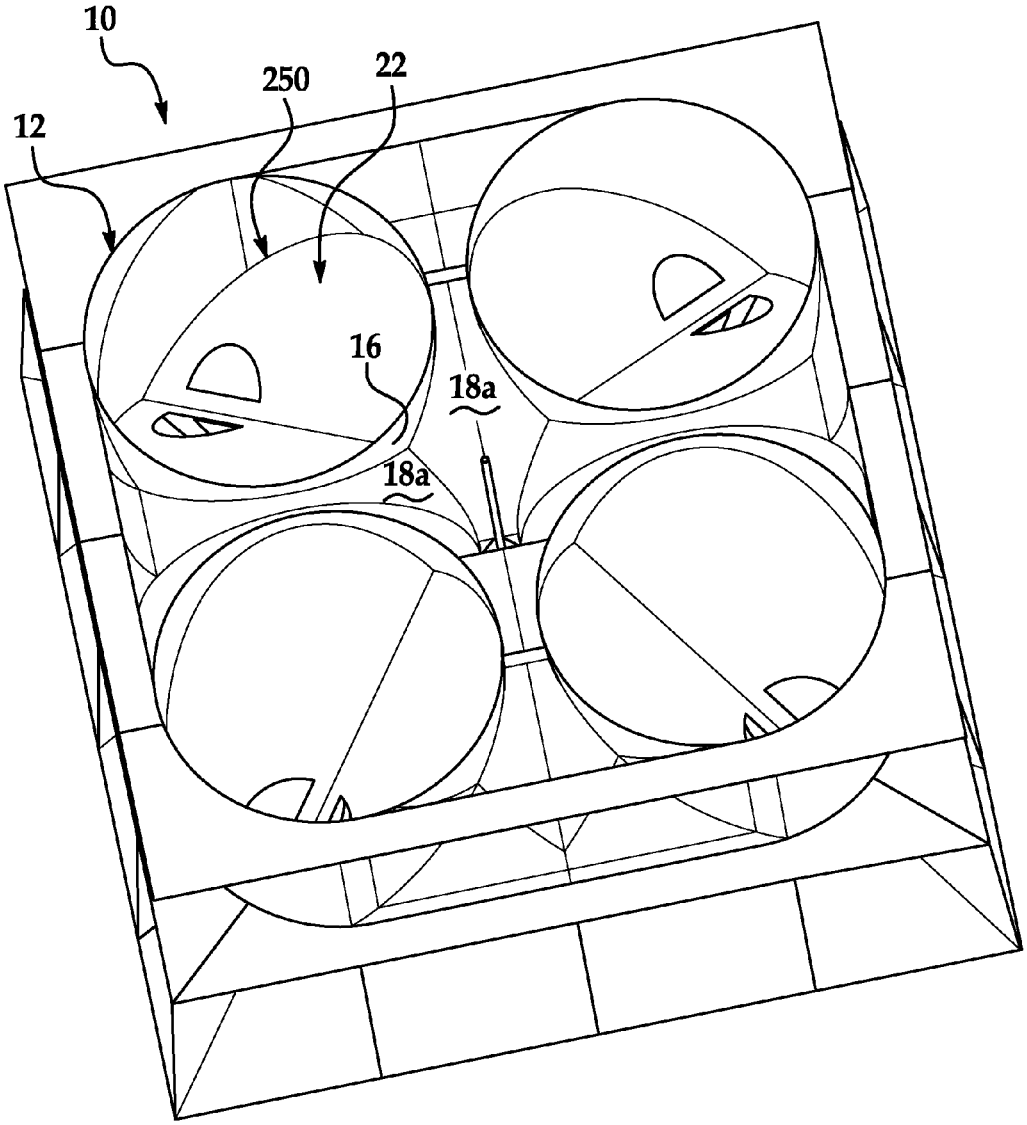
FIG. 16 is an alternate cut-away perspective view of the storage tank containment system in FIG. 11 showing an example of corner reinforcements positioned in the bottom corners of the storage tank.

FIGS. 15 and 16 show examples of horizontal, cut-away sections of the containment system 10 illustrating an example of a corner reinforcement 250 provided to reinforce the interior of corner portions 20. Referring to FIG. 15, a corner reinforcement 250 positioned in a bottom corner portion 20 of the storage tank 12 includes a first plate 252, a second plate 254 and a third plate 256 (angularly positioned below and extending downward from the first and second plate). The first 252, second 254 and third 256 plates span respective portions of the corner portion 20 and connect to the respective inner walls of the corner portion 20 inside storage chamber 22 as best seen in FIG. 16 (showing all four lower corner portions 20 having a corner reinforcement 250). It is understood some or all of the corner portions 20 may include a corner reinforcement 250, and that one or more of the corner reinforcements 250 may not be needed depending on the application.

In a preferred example shown, a first plate first edge 258, a second plate first edge 260 and a third plate first edge 262 each connect to the corner 20 along the adjacent joint 30 formed by a vertical wall 16 and horizontal walls 18. The first plate 252, second plate 254 and third plate 256 connect at a joint 264. In one example, first 252, second 254 and third 256 plates are spaced 120 degrees apart. It is understood that corner reinforcements 250 may take other configurations, plate or web formations to suit the particular application as known by those skilled in the art.

Figure 17:
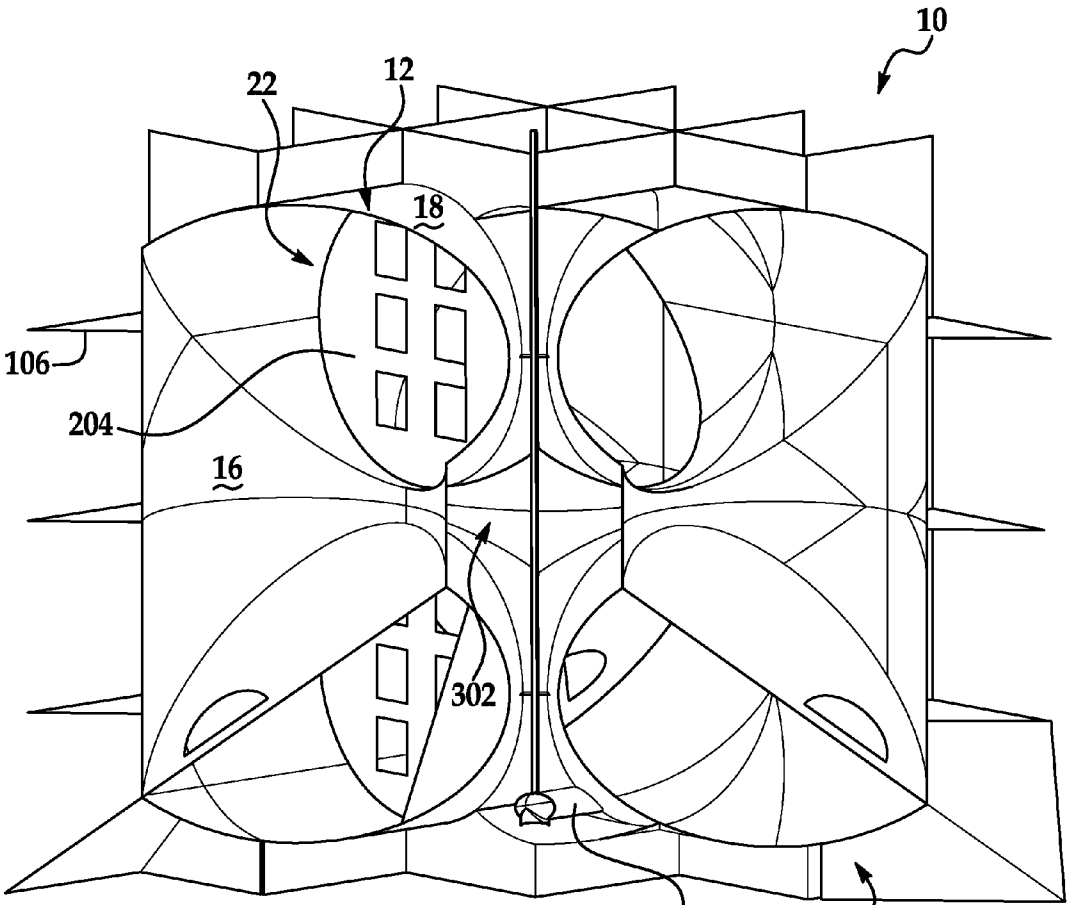
FIG. 17 is an alternate cut-away perspective view of the storage tank containment system in FIG. 11.

In the example bulkhead structure 250, each of the first plate 252, second plate 254 and third plate 256 define respective through apertures 270, 272 and 274 to permit fluid communication on either side of the plates, such that portions of the storage chamber 22 are not blocked off otherwise compartmentalized. As shown in FIG. 17, a bulkhead structure 250 can be positioned in each top corner portion 20 of the storage tank 12. It will be understood by those skilled in the art that other configurations and orientations for the bulkhead structure 250 may be used, and other reinforcements may be positioned in a corner portion 20.

Figure 19:
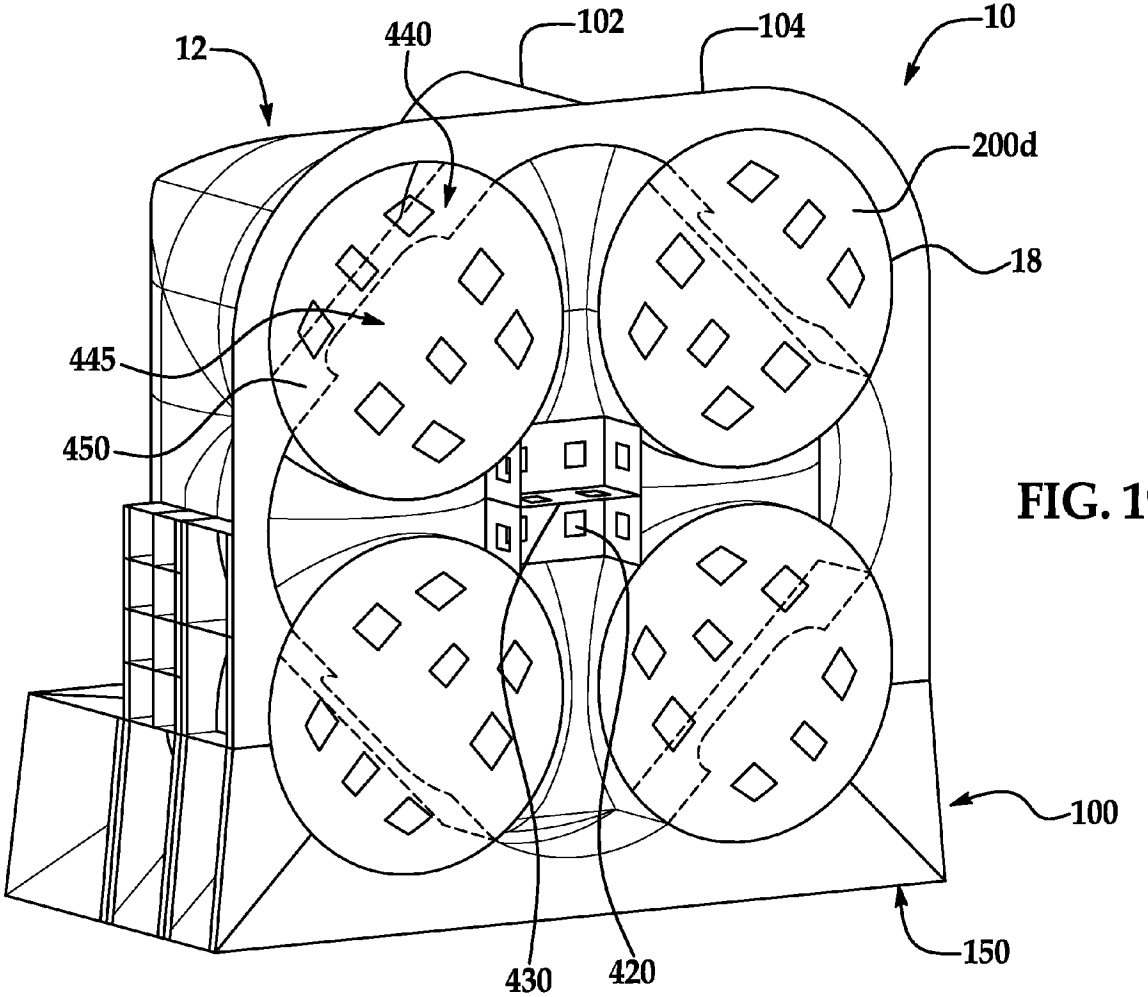
FIG. 19 is an alternate partially cut-away perspective view of the storage tank containment system in FIG. 11 showing alternate examples of corner reinforcements and gussets plates.

Referring to FIG. 19, an alternate example of a corner reinforcement 440 is shown. In the example, tank corner 20 reinforcement 440 is in the form of a plate 445 (only one-half of the plate shown in the sectional view in FIG. 19) defining an interior aperture 450 (surrounded by plate material 445). In the example, the plate 445 is angled at approximately 45 degrees and is seam welded on its ends, or alternately all around its perimeter to adjacent walls of the corner portion 20 and the adjacent vertical 16 and horizontal 18 cylindrical walls. The aperture 450 serves to reduce weight and provide resistance to sloshing of the stored fluid as described above. Other forms, configurations, orientations and positions of corner reinforcements to suit the particular application known by those skilled in the art may be used.

The material used to construct the storage tank 12 as described above may be used to construct the bulkheads 200, 250 and 440. In one example, the illustrated bulkheads 200, 250 and 440 are rigidly and continuously seam welded to the storage tank 12.

It will be understood that the illustrated corner reinforcements 250 and 440 may not be necessary or desirable in certain applications. Certain disclosed embodiments, for example the embodiment of FIGS. 1-10 with the first example of the exterior support structure 100, may not include corner reinforcements, as can be seen with reference to FIGS. 7-9. In this and other examples, the reinforcing function of the illustrated corner reinforcements 250 and 440, if desired, may be performed by other aspects of the storage tank 12 and/or exterior support structure 100.

In the example of the storage tank 12 described and illustrated above, the twelve cylindrical tubular walls 16 and 18 are closed sectioned, forming an interior storage chamber 22. In this example, openings 290 form on each of the six sides of the tank 12, leading to an interior space 295 between the interior facing walls of the cylinders. In the examples of the storage tank containment system 10 shown throughout the Figures, the openings 290 are sealed closed and the interior space 295 is placed in fluid communication with the storage chamber 22 inside the cylinders to utilize the interior space 295 as additional storage for the fluid, as explained below.

With representative reference to FIG. 19, it can be seen that closure plates 300*a* and interior facing portions of the cylinder walls 16 and 18*a* (e.g., an interior portion 310 of a vertical cylinder wall 16 and interior portion 312 of a horizontal cylinder wall 18*a* are indicated) may be used to seal off and define an interior storage chamber 302 defined by the closure plates 300 and interior wall portions 310 and 312 of the cylinder walls 16 and 18*a* forming the storage tank 12.

Figure 10A:
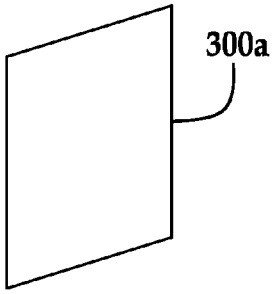
FIGS. 10A-10C are perspective views of examples of closure plates shown throughout the Figures for closing off the interior space shown in FIG. 9.
Figure 10B:
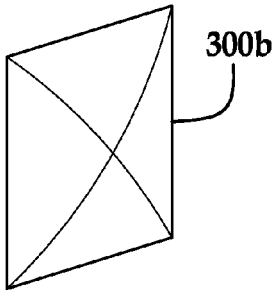
Figure 10C:
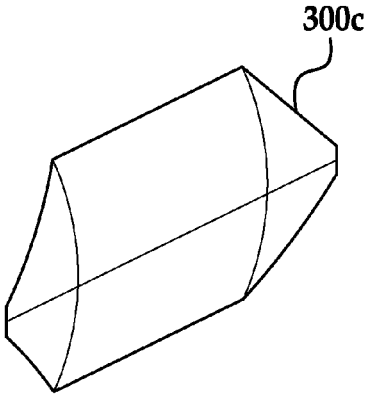

A number of configurations of closure plates 300 are shown throughout the Figures, which are explained with additional reference to FIGS. 10A-C. In the example shown in FIG. 10A, the closure plate 300*s* is planar and configured to extend normally between adjacent walls 14. In an alternate example shown in FIG. 10B, closure plate 300*b* is spherical or rounded and generally extends between adjacent walls 14, but at a position further outward of an imaginary line connecting longitudinal axes of adjacent walls 14. In the alternate example shown in FIG. 10C, closure plate 300*c* is also spherical or rounded, but extends between adjacent walls 14 at an outer portion of the walls 14, such that the closure plate 300*c* extends generally tangentially between adjacent walls 14.

Through use of the closure plates 300*a*, 300*b* or 300*c*, and corresponding use of interior space 295 for storage, increased storage capacity is achieved. In one example of a tank with dimensions described above, the volumetric storage efficiency of tank system 10, as compared to a similarly dimensioned cube, increases from about 0.81 to 0.88, which is far superior to prior designs.

The storage tank containment system 10 may be configured to include only one type of the closure plates 300*a*, 300*b* and 300*c*, for example, or may be configured to include a mixture of the closure plates 300*a*, 300*b* and 300*c*, as well as other closure plates not specifically illustrated. Closure plates 300*a*, 300*b* and 300*c* can be made from the materials used for the walls 16, 18*a* as described above. It will be understood by those skilled in the art that other configurations, orientations for the closure plates 300*a*, 300*b* and 300*c* may be used to seal and define an interior storage chamber 302.

Figure 9:
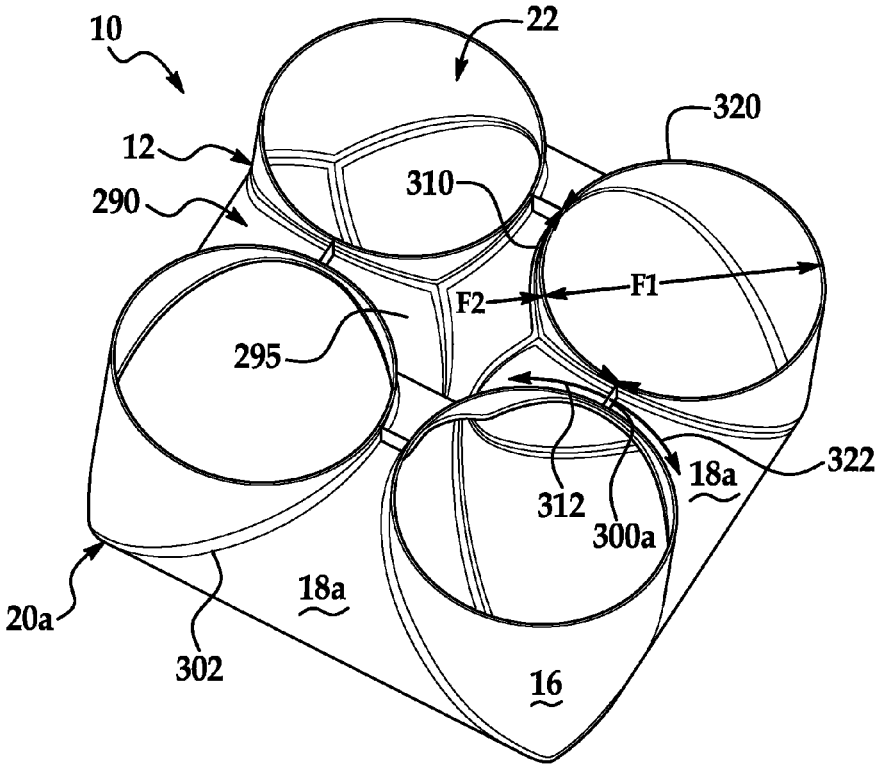
FIG. 9 is a cut-away perspective view of the storage tank of FIG. 1 taken along the line 9-9 showing an interior space formed between the cylinder walls.

As best seen in FIG. 9, in one example described above where the cylindrical walls 14 are closed-sectioned and the interior storage chamber 22 serves as the only storage area, the cylindrical walls 16 and 18*a* have exterior portions 320 and 322, respectively, for example the outer half or circumference of the circular cross-section which faces toward the exterior of the tank, and respective interior portions 310 and 312. As shown in FIG. 9, the respective first and second wall portions may be defined by or positioned near the location of the closure plates 300*a*. As shown in FIG. 9, liquid contained in the storage chamber 22 exerts a radial hydrostatic force F1 to an interior 310 of the vertical cylinder wall 16. The load bearing capacity of the vertical cylinder wall 310,320 must be sufficient to account for the force F1. Where closure plates 300*a* are not employed and the interior chamber 302 (or space 295) is not utilized for storage, the interior wall portions 310 must withstand similar loads as the exterior wall portions 320 and require substantially similar construction. In an application of tank system 10 in the size example noted above for containing LNG, the thickness of walls 16 and 18 for aluminum are estimated to be between 1 and 6 inches thick. For steel, a thickness of 0.5-4 inches may be used. Other thicknesses, depending on the material used and application, known by those skilled in the art may be used.

However, where closure plates 300*a* (or closure plates 300*b* or 300*c*) are employed and the interior storage space 302 utilized, the inclusion of a liquid in the interior storage chamber 302 will create an opposing radial hydrostatic force F2 to the opposite side of the vertical cylinder wall portion 310 that partially defines the interior storage chamber 302. Because the hydrostatic force F2 counteracts and counterbalances the hydrostatic force F1, the load bearing capacity and corresponding thickness of the vertical cylinder wall 16 and horizontal cylinder wall 18*a* can be reduced in the respective wall portions 310 and 312, which reduces the mass and the material cost of the storage tank 12.

In the example of the storage tank 12 utilizing only storage chamber 22 within the cylinder walls 14, one or more ports in the exterior of the walls (not shown) in communication with interior chamber 22 can be used to fill or withdraw fluid from the storage chamber 22. Where interior storage chamber 302 is used along with storage chamber 22, one or more ports (not shown), for example on wall portions 310 and/or 312 can be provided in the appropriate walls 14 to provide fluid communication between the storage chamber 22 and the interior storage chamber 302.

Figure 18:
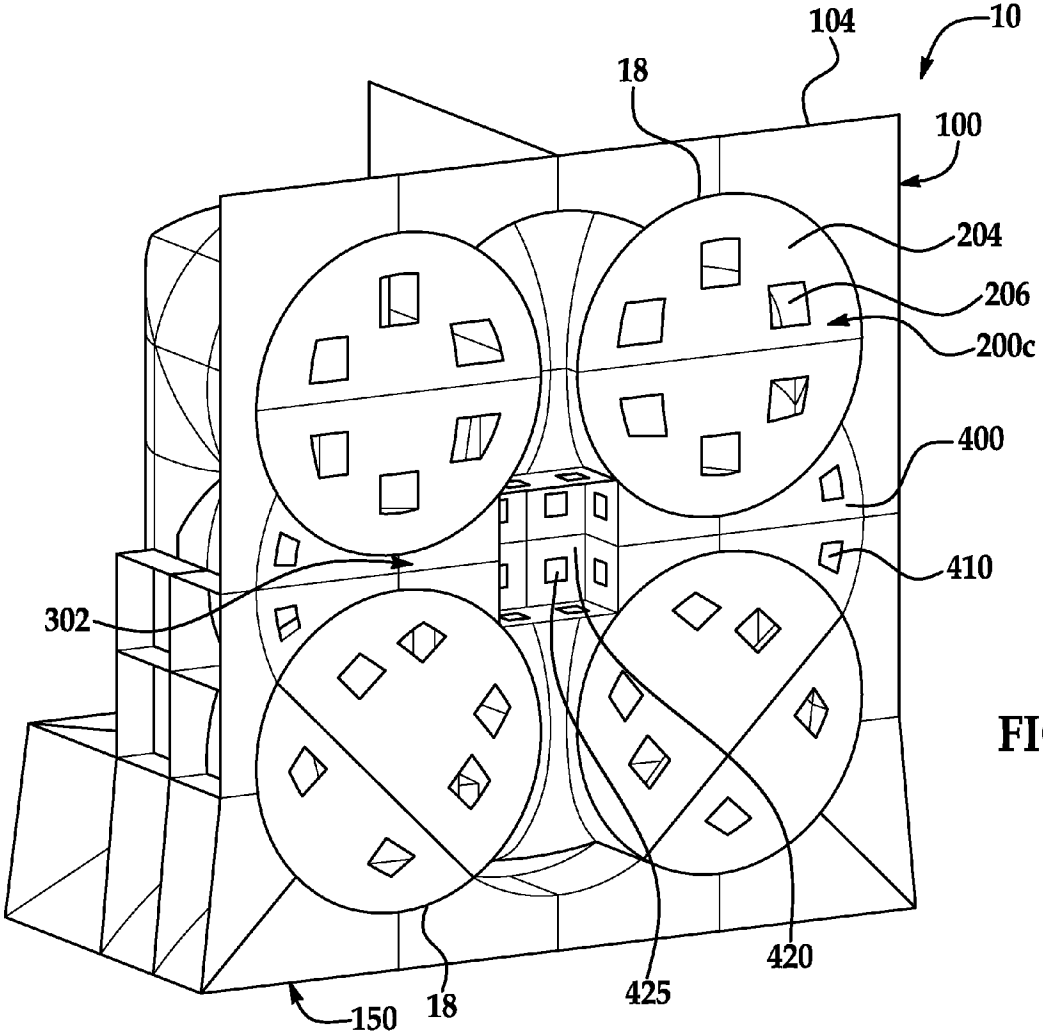
FIG. 18 is an alternate partially cut-away perspective view of the storage tank system in FIG. 11 showing further examples of gusset plates within the interior space of the storage tank.

Referring to FIG. 18, an example of first gusset plates 400 (two shown) are illustrated. In the example, each gusset plate 400 is positioned between the vertically adjacent horizontal tube walls 18 in the interior chamber 302 and are rigidly connected thereto. Each gusset plate 400 may include one or more aperture 410 (two shown) to permit the flow of fluid through the gusset plate to deter sloshing of fluid in interior chamber 302 as generally described for bulkheads 200 described above. In one example, the gusset plates are rigid planar plates, but may take other forms and configurations to suit the application as known by those skilled in the art.

As also seen in FIG. 18, one or more second gusset plates 420 are positioned between and rigidly connected to the first gusset plates 400 and the horizontal cylinders 18 as generally shown. In the example, second gussets 420 preferably have a plurality of similar apertures 425 to permit a restricted flow of fluid to deter sloshing of the fluid inside the interior chamber 302. The first 400 and second 420 gussets provide both structure reinforcement and deter sloshing of fluid inside the chamber 302. Other gussets, reinforcement plates and sloshing deterring structures known by those skilled in the field may be used. For example, as seen in FIG. 19, the second gusset plates 420 are used without the first gusset plates 400. In the example, the second gusset plates 420 are rigidly connected to the four adjacent horizontal cylinder walls 18 and further include a third gusset plate 430 which is generally shown in a horizontal position between the generally vertically-oriented second gusset plates 420.

Figure 8:
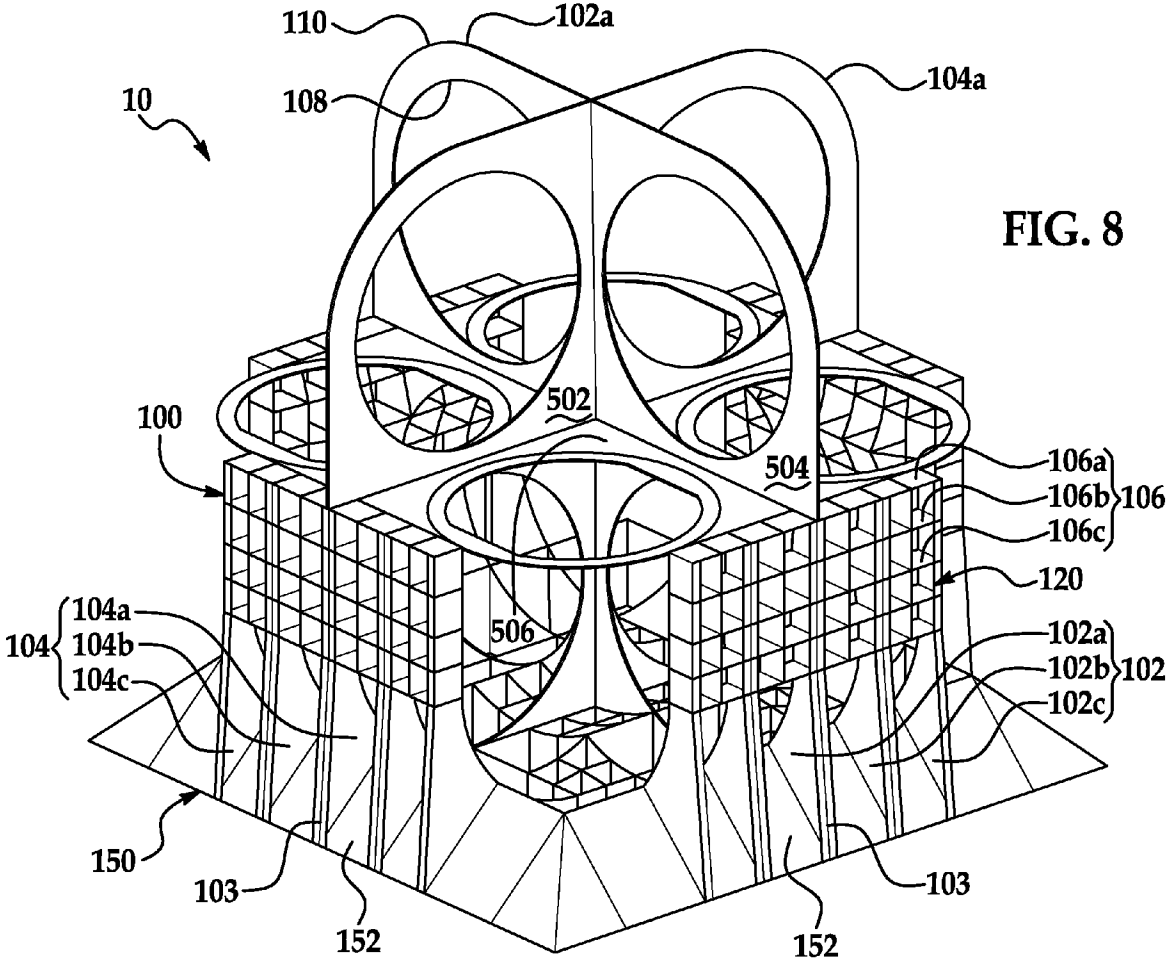
FIG. 8 is a perspective view of the storage tank containment of FIG. 1 similar to FIG. 7 without showing the storage tank and bulkheads.

As further seen in FIGS. 7 and 8, gusset plates 502 and 504 can be positioned between and rigidly connected to vertically adjacent parallel horizontal cylinder walls 18 in the interior chamber 302, while a gusset plates 506 is positioned between and rigidly connected to horizontally adjacent parallel vertical cylinder walls 16. In addition, the gusset plates 502, 504 and 506 are connected at their respective intersections. Each of the gusset plates 502, 504 and 506 extend in a plane passing through a center of the storage tank 12. The gusset plates 502 and 504 extend vertically in parallel with respective opposing side faces of the storage tank 12, and discontinue at an intersection with the walls 14, as well at an intersection with respective adjacent gusset plates. The gusset plate 506 extends horizontally in parallel with opposing top and bottom faces of the storage tank 12, and also discontinues at an intersection with the walls 14, as well as at an intersection with respective adjacent gusset plates. Only three gusset plates 502, 504 and 506 out of eight total gusset plates are indicated and described for clarity. It can be seen and understood that the other of the gusset plates are positioned and configured similarly to the gusset plates 502, 504 and 506.

As shown, the gusset plates 502, 504 and 506 can be rigidly interconnected at their intersections, as well as interconnected with the support structure 100. As shown, the vertically disposed gusset plates 502 and 504 connect to the central vertical braces 104*a* and 102*a*, respectively, while the horizontally disposed gusset plate 506 connects to the horizontal brace 106*a*. The gusset plates 502, 504 and 506 can fluidly compartmentalize the interior chamber 302, or as explained above, may include one or more apertures (not shown in this example) to permit a flow of fluid.

Figure 13:
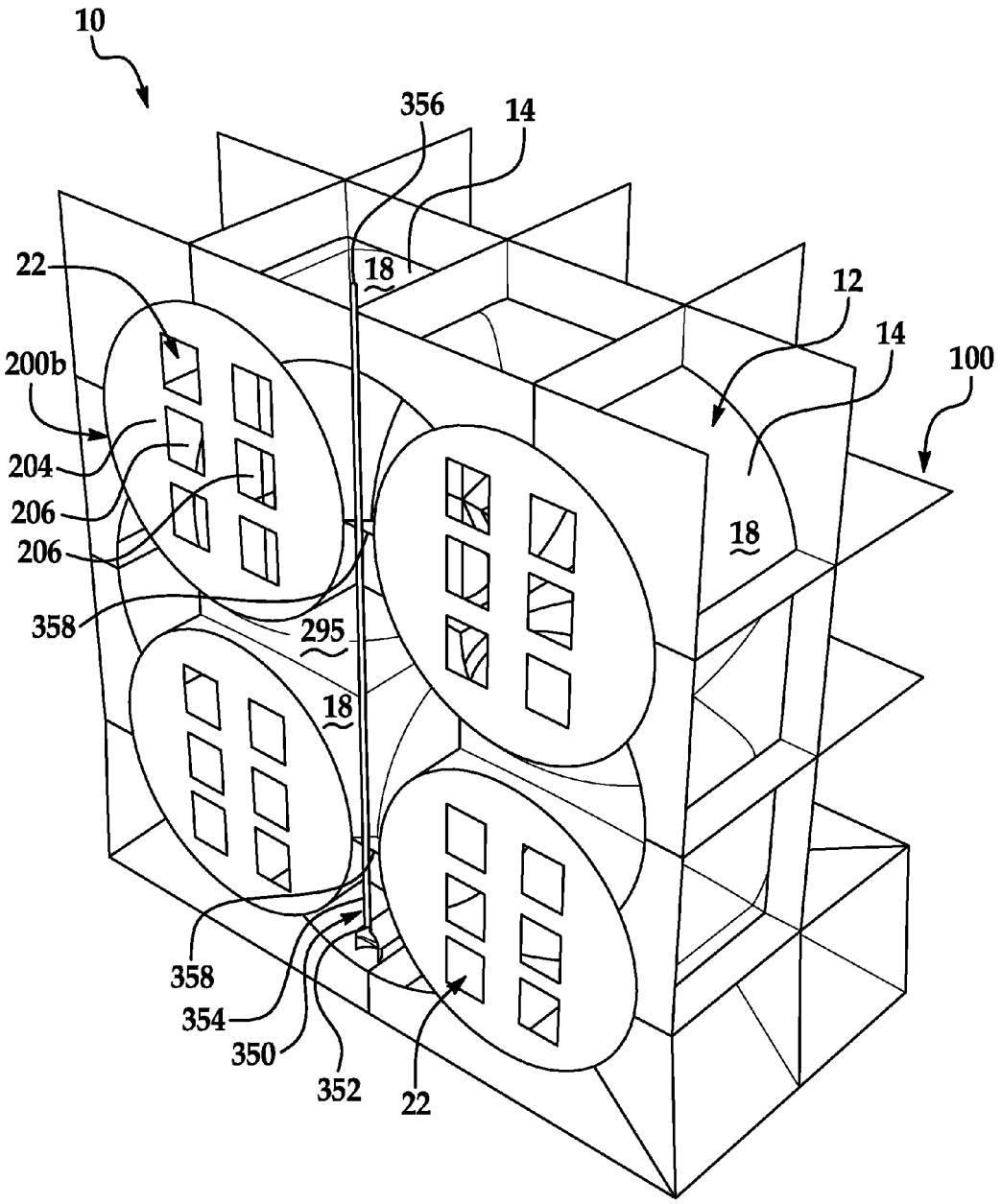
FIG. 13 is a cut-away perspective view of the storage tank system in FIG. 5 showing alternate examples of bulkheads positioned in the horizontal cylinder walls of the storage tank.
Figure 14:
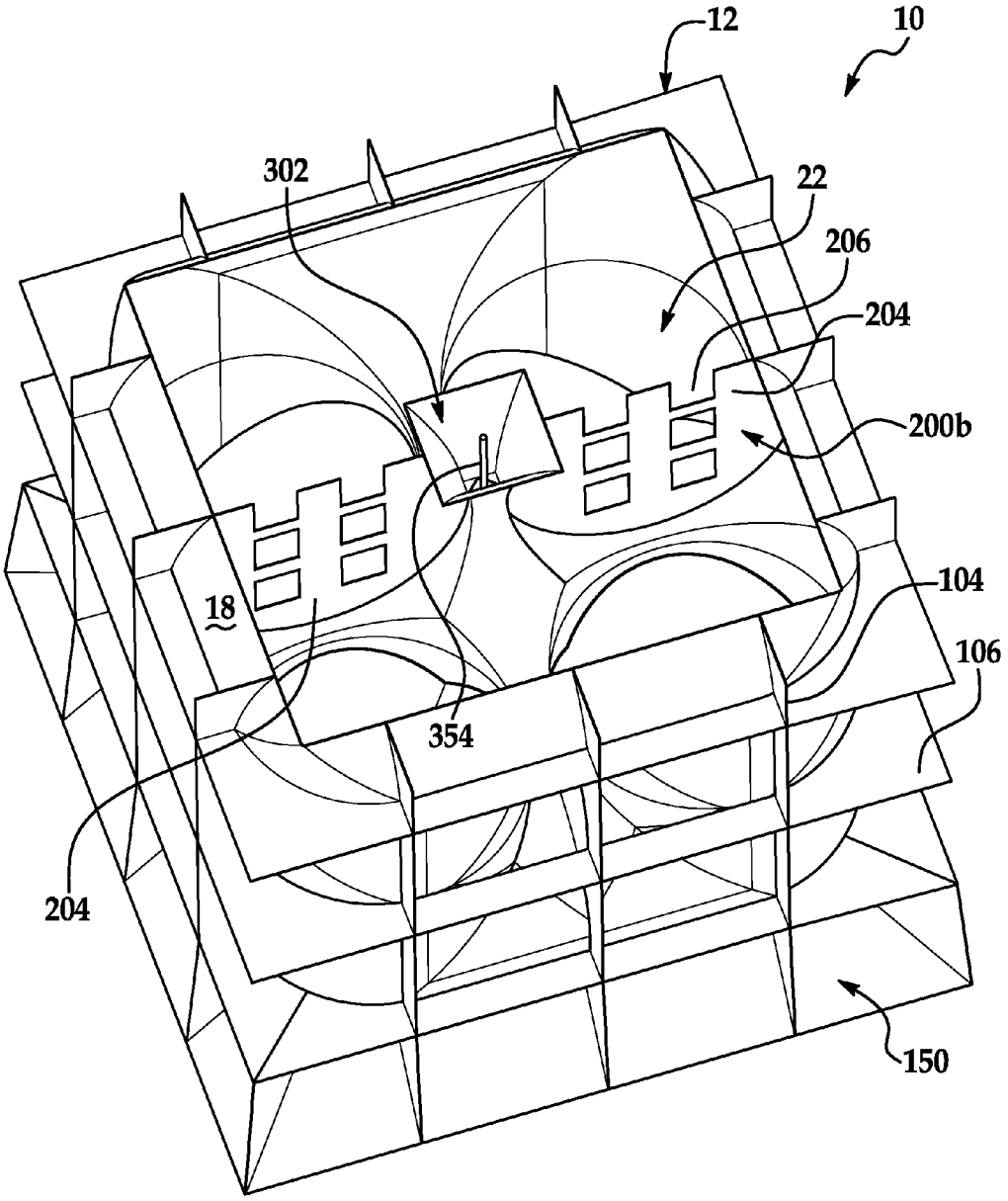
FIG. 14 is an alternate cut-away perspective view of the storage tank containment system in FIG. 11 showing the bulkheads positioned in the horizontal cylinder walls of the storage tank.

Referring to FIGS. 13 and 15, one example of a device for filling and extracting fluid from tank 12 is in the form of a filling tower 350. In the example, tower 350 includes a substantially horizontal hollow tube 352 connected to a substantially vertical hollow tube 354. The vertical tube 354 includes an intake port 356 positioned near the top of the storage tank 12, or extending therefrom, and is configured to connect to a remote fluid source, such as a transfer pump (not shown) or other devices known by those skilled in the art.

As shown in FIG. 15, the horizontal tube 352 can connect to and through one or more of the cylinder horizontal walls 18 to provide fluid communication between the intake port 356 and the storage chamber 22. In the example, the vertical tube 354 is supported by a plurality of support brackets or structures 358 which preferably permit fluid communication on either side of the support structures 358. The vertical tube 354 can include one or more ports (not shown) to provide fluid communication between the intake port 356 and the interior storage chamber 302. Alternately, through ports (not shown) may be used through the interior portions of walls tubular walls 16*b* and/or 18*b* to ease the flow of fluid into and out of the tank 12. The filling tower 350 can also be used to extract a fluid from the storage chamber 12 and the interior storage chamber 302. It is understood that other tubes, pipes or ports may be used to permit the rapid, high volume flow of fluid into and out of the tank 12 to facilitate filling and extracting the fluid known by those skilled in the art may be used.

It will be understood that the above described embodiments, features and examples of the structures and features of the storage tank containment system 10 may be altered and/or combined in a wide variety of manners according to one or more design, strength, manufacturing, cost and/or other criteria. FIG. 7 is illustrative of the features of the storage tank containment system 10 in the first example that incorporates certain of the above described inventive external, internal, and other structures for the storage tank 12 in what is presently considered to be a preferred arrangement.

In the first example, the storage tank containment system 10 includes the storage tank 12 having the above described corner portions 20*a* formed in combination with the closure member 60 as shown in FIGS. 4, 5A and 6A. The support structure 100 and base 150 are constructed in accordance with the discussion of FIGS. 1-3, 7 and 8. As shown, the example further includes internal structures configured for the storage and management of fluid within the storage chamber 22 and elsewhere. For example, the storage tank containment system 10 includes the bulkhead structure 200*a*, wherein the planar plate 204 is composed of the reinforcing outer periphery 204*a* and the membrane inner portion 204*b* configured to partially obstruct a flow of liquid by defining the ovoid apertures 206. The interior space 295 is defined in part with the closure plates 300*b*, and houses the crossing gusset plates 502, 504 and 506 positioned between and rigidly connected to the walls 14.

The exemplary storage tank 12 has dimensions of 150 feet (f) or 50 meters (m) per geometric side. In an application of storing LNG, the thickness of aluminum plate forming the bottom horizontal cylinder walls 18 can vary between approximately 2-5 inches, the thickness of aluminum plate forming the top horizontal cylinder walls 18 can vary between approximately 0.5-3 inches, the thickness of aluminum plate forming the vertical horizontal cylinder walls 16 can vary between approximately 2-4 inches, the thickness of aluminum plate forming the bottom corner portions 20 can vary between approximately 3-6 inches, and the thickness of aluminum plate forming the top corner portions 20 can vary between approximately 1-3 inches. Aluminum forming the closure plate 300*b* can vary in thickness between approximately 2-4 inches. Aluminum forming the closure member 60 can vary in thickness between approximately 4-6 inches at the bottom corner portions 20, and between 3-4 inches at the top corner portions 20.

The thickness of aluminum plate forming the components of the support structure 100 and the above described internal structures and reinforcements can generally vary between approximately 1-3 inches. Certain portions of the support structure 100, for example the T-plates 103 and reinforcing outer periphery 204*a* of the planar plate 204, can formed from aluminum plate with a thickness varying between approximately 3-6 inches.

These dimensions are based on one contemplated design case and are given as a non-limiting example. It will be understood that other thicknesses, depending on the material used and application, may be used.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A storage containment tank for use in containing a large volume of high pressure compressed natural gas (CNG) or a large volume of liquid natural gas (LNG), the storage tank comprising:

four rigid substantially vertical hollow tubular walls positioned approximately 90 degrees apart, the vertical walls each having a longitudinal axis and a first and a second end;

four rigid substantially horizontal upper hollow tubular walls each having a longitudinal axis interconnecting and in fluid communication with the respective first ends of the vertical tubular walls;

four rigid substantially horizontal lower hollow tubular walls each having a longitudinal axis interconnecting and in fluid communication with the respective second ends of vertical tubular walls, the upper horizontal tubular walls, the lower horizontal tubular walls and the vertical tubular walls forming a six-sided cubic-shaped tank configuration defining an interior fluid storage chamber;

a closure plate positioned on each side of the six sides of the tank connected to the adjacent upper and lower horizontal and vertical tubular wall outer surfaces to define a central storage fluid chamber;

a tank support connected to the outer surfaces of the lower horizontal tubular walls on at least four of the six sides of the tank, the tank support operable to reinforce the tank against static and dynamic loading from the stored fluid in the interior and central storage chambers; and a bulkhead positioned inside at least one of the horizontal tubular walls and oriented transverse to the longitudinal axis, the bulkhead defining at least one aperture to permit a restricted flow of fluid through the bulkhead, the bulkhead including a rigid outer periphery configured for reinforcing a cylindrical cross section of the respective horizontal tubular wall and a flexible membrane inner portion defining the at least one aperture.

2. The storage tank of claim 1 wherein the tank support further comprises a base and a plurality of vertical braces connected to the base and extending outward from the at least four sides of the tank.

3. The storage tank of claim 2 wherein the plurality of vertical braces further comprises a first central vertical brace and a second central vertical brace, the first and the second central vertical braces connected to and extending upward from the base and circumscribing the outer surfaces of the respective and adjacent four sides of the tank and the respective closure plates.

4. The storage tank of claim 3 wherein each of the first and the second central vertical braces further comprise four vertical gusset plates, each gusset plate circumscribing an adjacent horizontal tubular wall and connecting to the adjacent seven gusset plates.

5. The storage tank of claim 4 further comprising a central horizontal brace, the horizontal brace comprising four horizontal gusset plates circumscribing a respective vertical hollow tubular wall, each of the four horizontal gusset plates connecting to the other three horizontal gusset plates and interconnecting to the vertical gusset plates.

6. The storage tank of claim 2 wherein the plurality of vertical braces further comprises at least three vertical braces each circumscribing the outer surfaces of respective and adjacent four sides of the tank.

7. The storage tank of claim 2 wherein the vertical braces substantially conform to and continuously connect to a contour of the outer surface of lower horizontal tubular walls.

8. The storage tank of claim 2 further comprising at least two transverse braces extending outward from the respective tank side and interconnecting the vertical braces on the respective tank side.

9. The storage tank of claim 8 wherein the at least two transverse braces comprise a plurality of transverse braces.

10. The storage tank of claim 8 wherein the at least two transverse braces are oriented substantially horizontal.

11. The storage tank of claim 8 wherein the at least two transverse braces circumscribe the four adjacent tank sides.

12. The storage tank of claim 2 wherein the base further comprises a plurality of interconnecting braces extending downward from a bottom side of the six sides of the tank.

13. The storage tank of claim 11 wherein a bulkhead is positioned in each of the upper and the lower horizontal tubular walls.

14. The storage tank of claim 11 wherein at least one of the lower horizontal tubular walls defines a through port adapted to place the interior fluid chamber in fluid communication with the central fluid chamber.

15. The storage tank of claim 11 further comprising a filling tower having an intake port and at least one pipe for communicating fluid to and from the interior fluid chamber.

16. A storage containment tank for use in containing a large volume of high pressure compressed natural gas (CNG) or a large volume of liquid natural gas (LNG), the storage tank comprising:

four rigid substantially vertical hollow tubular walls positioned approximately 90 degrees apart, the vertical walls each having a longitudinal axis and a first and a second end;

four rigid substantially horizontal upper hollow tubular walls each having a longitudinal axis interconnecting and in fluid communication with the respective first ends of the vertical tubular walls;

four rigid substantially horizontal lower hollow tubular walls each having a longitudinal axis interconnecting and in fluid communication with the respective second ends of vertical tubular walls, the upper horizontal tubular walls, the lower horizontal tubular walls and the vertical tubular walls forming a six-sided cubic-shaped tank configuration defining an interior fluid storage chamber;

a closure plate positioned on each side of the six sides of the tank connected to the adjacent upper and lower horizontal and vertical tubular wall outer surfaces to define a central storage fluid chamber;

a tank support operable to reinforce the tank against static and dynamic loading from the stored fluid in the interior and central storage chambers, the tank support comprising a base having a plurality of interconnecting braces extending downward from a bottom side of the six sides of the tank, a first central vertical brace connected to the base and extending outward from a top side of the tank and two opposing upright sides of the tank and, and a second central vertical brace connected to the base and extending outward from the top side of the tank and two other opposing upright sides of the tank than the first central vertical brace; and a bulkhead positioned inside at least one of the horizontal tubular walls and oriented transverse to the longitudinal axis, the bulkhead defining at least one aperture to permit a restricted flow of fluid through the bulkhead, the bulkhead including a rigid outer periphery configured for reinforcing a cylindrical cross section of the respective horizontal tubular wall and a flexible membrane inner portion defining the at least one aperture.

17. The storage tank of claim 16 wherein each of the first and the second central vertical braces further comprise four vertical gusset plates, each gusset plate circumscribing an adjacent horizontal tubular wall and connecting to the adjacent seven gusset plates.

18. The storage tank of claim 17 further comprising a central horizontal brace, the horizontal brace comprising four horizontal gusset plates circumscribing a respective vertical hollow tubular wall, each of the four horizontal gusset plates connecting to the other three horizontal gusset plates and interconnecting to the vertical gusset plates.

* * * * *